US008094040B1

(12) United States Patent
Cornett et al.

(10) Patent No.: US 8,094,040 B1
(45) Date of Patent: Jan. 10, 2012

(54) METHODS AND APPARATUS FOR ELECTRONICALLY DETECTING SIREN SOUNDS FOR CONTROLLING TRAFFIC CONTROL LIGHTS FOR SIGNALLING THE RIGHT OF WAY TO EMERGENCY VEHICLES AT INTERSECTIONS OR TO WARN MOTOR VEHICLE OPERATORS OF AN APPROACHING EMERGENCY VEHICLE

(76) Inventors: Robertt H. Cornett, Valley Village, CA (US); Jeffery I. Berlin, Northridge, CA (US)

( * ) Notice: Subject to any disclaimer, the term of this patent is extended or adjusted under 35 U.S.C. 154(b) by 1277 days.

(21) Appl. No.: 11/591,155

(22) Filed: Nov. 1, 2006

Related U.S. Application Data

(60) Provisional application No. 60/732,938, filed on Nov. 2, 2005.

(51) Int. Cl.
*G08G 1/00* (2006.01)

(52) U.S. Cl. ..... 340/902; 340/907; 340/916; 340/917

(58) Field of Classification Search ..... 340/902
See application file for complete search history.

(56) References Cited

U.S. PATENT DOCUMENTS

| | | | | | |
|---|---|---|---|---|---|
| 4,553,628 | A | * | 11/1985 | Nakamura | 181/145 |
| 4,625,206 | A | * | 11/1986 | Jensen | 340/902 |
| 4,759,069 | A | * | 7/1988 | Bernstein et al. | 381/56 |
| 4,785,474 | A | * | 11/1988 | Bernstein et al. | 381/56 |
| 4,806,931 | A | * | 2/1989 | Nelson | 340/907 |
| 4,864,297 | A | * | 9/1989 | Shaw et al. | 340/902 |
| 5,278,553 | A | * | 1/1994 | Cornett et al. | 340/902 |
| 5,287,411 | A | * | 2/1994 | Hill et al. | 704/231 |
| 5,495,242 | A | * | 2/1996 | Kick et al. | 340/902 |
| 5,497,148 | A | * | 3/1996 | Oliva | 340/905 |
| 5,677,684 | A | * | 10/1997 | McArthur | 340/906 |

FOREIGN PATENT DOCUMENTS

| | | | |
|---|---|---|---|
| DE | 2708226 | A1 * | 8/1978 |
| WO | WO 9307603 | A1 * | 4/1993 |

OTHER PUBLICATIONS

E. Hausmann & R. Slack, "Physics" Text, pp. 570-575 Second Edition Copyright 1935, 1939, D. Van Nostrand Co. Inc.

* cited by examiner

*Primary Examiner* — Eric M Blount
(74) *Attorney, Agent, or Firm* — Edward J. DaRin, Esq

(57) ABSTRACT

A siren sensor for detecting siren sounds emitted from emergency vehicles and electronic processing circuits for detecting and identifying the siren sounds electronically to control the traffic signal lights at an intersection to permit only the emergency vehicle to travel through an intersection with the right of way. The method and apparatus utilizes an acoustic horn in combination with a microphone for receiving the siren sounds and converting them to corresponding electrical signals. A conventional horn is modified to function as an acoustic lens to filter and amplify the siren sounds applied to the microphone. The modified acoustic horn and microphone combination comprise a tuned and directional audio sensor sensitive in the frequency range of an emergency vehicle siren. The electronic signal processing circuitry amplifies the resulting microphone signals to obtain the maximum sensitivity to the frequency spectrum of siren sounds. Detectors tuned to a harmonic of the siren signals is utilized for eliminating extraneous sounds along with unique filtering to band pass only sounds in siren frequency spectrum to a phase locked loop detector. The validity of the detected signal is verified by tracking a portion of the siren signal in pre-selected increment under time constraints to lock up and unlock the detector to verify a valid siren sound signal has been detected and provides a valid output signal for use in controlling a conventional traffic light sequencing control or to warn a motorist of an approaching emergency vehicle.

8 Claims, 18 Drawing Sheets

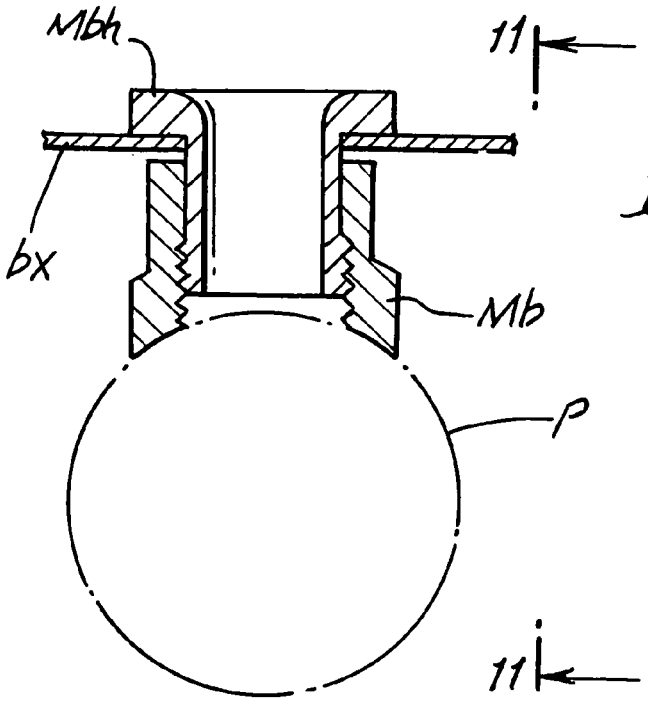
FIG. 10.
FIG. 11.
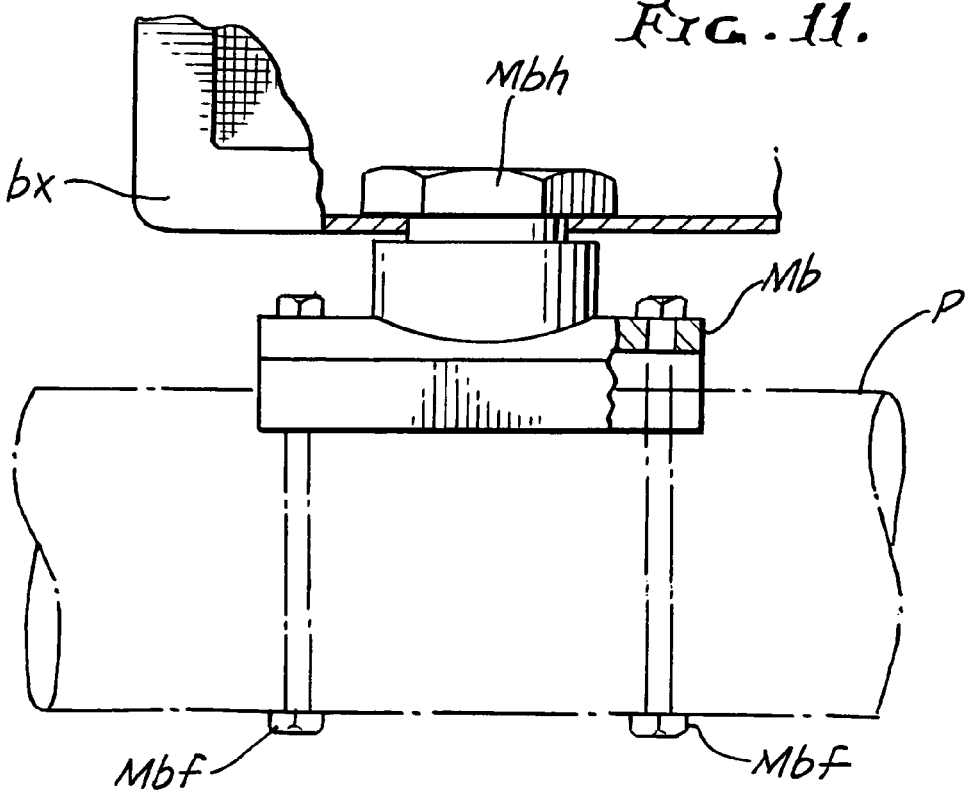

METHODS AND APPARATUS FOR ELECTRONICALLY DETECTING SIREN SOUNDS FOR CONTROLLING TRAFFIC CONTROL LIGHTS FOR SIGNALLING THE RIGHT OF WAY TO EMERGENCY VEHICLES AT INTERSECTIONS OR TO WARN MOTOR VEHICLE OPERATORS OF AN APPROACHING EMERGENCY VEHICLE

RELATED APPLICATION

Priority is claimed on the basis of the provisional application bearing Ser. No. 60/732,938 filed on Nov. 2, 2005 entitled 4 in 1 Siren Sensor System

BACKGROUND OF INVENTION

Siren sensor systems for warning motor vehicle operators of an approaching siren sounding emergency vehicles of various types are disclosed in the prior art. Siren Sensor systems for controlling traffic control lights at intersections upon the detection of a siren sound for permitting an emergency vehicle to safely cross an intersection with the right of way are also disclosed in the prior art.

U.S. Pat. No. 5,278,553 Cornett et al discloses methods and apparatus for detecting siren sounds emitted by an emergency vehicle approaching from a distance to warn a motor vehicle operator of an approaching vehicle in sufficient time to permit the vehicle operator to take corrective action to permit the emergency vehicle to safely continue on its path.

U.S. Pat. No. 4,806,931, Nelson discloses an electronic system for the recognition of emergency siren signals for effecting control of traffic signal lights at an intersection in response to the detected siren sound to allow an emergency vehicle to travel through the intersection with the right of way. This electronic system is dependent on the recognition of different types of emergency vehicle siren sound patterns programmed into a microprocessor. The recognition of the different signal patterns is dependent on a recognition algorithm for an individual predetermined repetitive sound pattern. The output signal from this system signals the presence of a predetermined sound pattern and the direction of the sound pattern based on a multiplicity of directional microphones wherein the signal producing the largest output amplitude provides one directional information.

The Nelson U.S. Pat. No. 4,806,931 describes various operating modes for siren sounds and refers to other prior art system that are unique to certain siren sounds such as a "yelp" siren and not other types of siren warning sounds as is possible by the system of the '931 patent. The '931 system utilizes omni-directional microphone and four directional microphones corresponding to the directions north, south, east, and west relative to the intersection the emergency vehicle is approaching. The system is dependent on first determining if a siren sound pattern has been detected in order to initiate the directional processing of the detected signals as represented in FIG. 2 of the '931 patent.

U.S. Pat. No. 4,625,206, Jensen, also discloses an electronic system for providing directional control of traffic signals. The disclosed system is particularly suited to detecting "yelp" siren signals and is a relatively expensive circuit installation.

Another prior art technique for responding to siren sounds for warning a motor vehicle operator of an approaching emergency vehicle sounding its siren is disclosed in U.S. Pat. No. 4,785,474, Bernstein et al.

U.S. Pat. No. 5,495,242, Kick et al, discloses an early warning system for hearing impaired motor vehicle operators for warning the drivers of the proximity of an emergency vehicle. This is an attempt to detect all kinds of siren sounds by means of a single system. The '242 patent also describes an embodiment for pre-emptive traffic signal controller responsive to the detection of a siren sound for overriding a traffic light controller to insure that the siren sounding vehicle has a green light to proceed through an intersection and to stop cross traffic.

Despite the number of prior art systems based on the detection of the sound waves emitted from a siren, there is no known commercially available, reliable siren sensor system presently available for controlling traffic control lights at an intersection. Accordingly, there is a present need for a relatively inexpensive, reliable electronic processing system for controlling traffic control lights in favor of an emergency vehicle at an intersection to permit the vehicle to travel through the intersection with the only right of way.

BRIEF SUMMARY OF INVENTION

The present invention provides an improved, relatively inexpensive method and apparatus for detecting siren sounds that provides output signal representative of the prevailing siren sound useful for both controlling traffic light signals at an intersection and to give a warning signal to a motor vehicle operator of an approaching siren sounding emergency vehicle. The method and apparatus is not limited to any one particular type of siren sound but it is applicable to all siren sounds emitted by most, current American sirens and to further eliminate extraneous sounds take advantage of the rich harmonic overtones of the siren sounds by utilizing a preselected harmonic for better discrimination of the sounds, preferably the third harmonic frequency of the siren sound.

The method and apparatus of the present invention advantageously utilizes an acoustic horn in combination with a microphone for further eliminating extraneous sounds from being coupled to the electronic siren sensor processing circuitry. The acoustic horn is used as an acoustic lens in accordance with the teachings of the present invention. The microphone or sound to electrical signal transducer is mounted with the horn for coupling the siren sound frequencies adjacent the focal point for the acoustic horn whereby the lens effect of the horn functions to filter and amplify the sound at the frequencies in the range of the siren signals. When the method and apparatus of the present invention is utilized for controlling traffic light signals the sound receiving end of the acoustic horn is provided with means to prevent detrimental environmental factors such as rain, snow, moisture, dust or the like from entering the acoustic horn while permitting the siren sounds to enter the horn. The microphone utilized with an acoustic horn is mounted at the rear of the horn from the sound entering end facing the sound entering end of the horn. The horn-microphone comprises a tuned and directional audio sensor sensitive in the frequency range of an emergency vehicle siren.

The siren sound electrical signals derived from the acoustic horn microphone are amplified by a pre-selected number of stages that have an appropriate gain and frequency response, provided by the selected components of the input circuitry for the amplifiers, of an emergency vehicle's siren sound that assures maximum sensitivity to the frequency spectrum of an emergency vehicle's siren sound. The electronic detector of the siren sound signals advantageously utilizes phase locked loop detectors tuned to the frequency of the third harmonic of the siren signals to further eliminate extraneous sounds causing false or erroneous signaling. To assure that the output signal from the electronic detector provides a valid signal representing the detected siren sensor signal, the electrical signals are first amplified and frequency band limited before being coupled to the electronic detecting circuitry by means of a unique filtering technique to further discriminate and band pass only sounds in siren frequency spectrum. The filtering of the signals results by biasing the last stage of amplification in a near oscillating mode by frequency determining components at the input of amplifier. This oscillatory frequency is beyond the high end of the siren frequency spectrum and is approximately 1800 Hertz. The amplifier includes stabilizing circuit means to prevent the amplifier from going into oscillation. The signals that are received by the amplifier that are in the siren frequency range siren below the 1800 Hertz are locked on by the amplifier as the amplifier goes into oscillation and phase locks to the signal and thereby defining a filter of an extremely high Q over the entire frequency range of the siren bandwidth, 600-1600 Hertz, that is coupled to the phase locked loop variable frequency detector. The frequency detector receives a siren frequency signal from the filtering circuit it locks the detector at the siren frequency and causes an output signal to be generated for commencing of the tracking of a portion of the siren signal to validate that the sound received is a siren signal. The initial frequency for locking up the detector occurs at the high end of the siren's frequency spectrum. The detector output signal is utilized to initiate a timing circuit for a pre-selected period for detecting the time intervals when the detector locks and unlocks with the siren frequency decreasing through its frequency range causing the detector to change state and creates a count pulse to be applied to a binary coded decimal counter. The counter provides a four bit binary coded count to a multiplexing switching circuit that provides a decimal output signal to a resistor ladder network. The zero count for the electronic counter couples a resistor of a pre-selected resistance to the basic frequency changing circuit for the phase locked loop detectors. With the initial decrease in siren frequency, the decimal counter, after the first lock-unlock cycle of the phase locked loop (detector) the counter multiplex switching circuit selects a first resistor of the ladder network to be serially added to the zero count resistor so that the detector is tuned to a lower siren frequency. This permits the detector to sense the decreased frequency and lock the detector, so that as it continues through its cycle another unlocking of the detector occurs so as to repeat the counting up of the electronic counter and a further resistor is selected by the multiplex circuit to track the decreasing siren frequency. The lock-unlock time intervals must occur within the time period of the timing circuit for each siren frequency detected and if it is longer, the detector circuit and the counter will be reset. This action proceeds for a pre-selected count of the binary coded decimal electronic counter to track the pre-selected increments of the siren frequency during the designated time period. The final count of the electronic counter provides an output signal directly to the output circuit for the processing circuit for signaling that a true, valid siren frequency has been detected. This output signal may be utilized in combination with the conventional traffic light controller for producing the desired right of way for the emergency vehicle.

BRIEF DESCRIPTION OF THE DRAWINGS

These and other features of the present invention may be fully appreciated when considered in light of the following specification and drawings in which:

FIG. 10 is a partial, cross-sectional view, taken along the line 10-10 of FIG. 8 illustrating the securement of the siren sensor housing to the traffic light supporting pole, the latter shown in dotted outline;

FIG. 11 is a view taken along the line 11-11 of FIG. 10 showing the mounting of the siren sensor housing to the traffic light supporting pole, illustrated in dotted outline;

DETAILED DESCRIPTION OF THE PREFERRED EMBODIMENT

Figure 3:
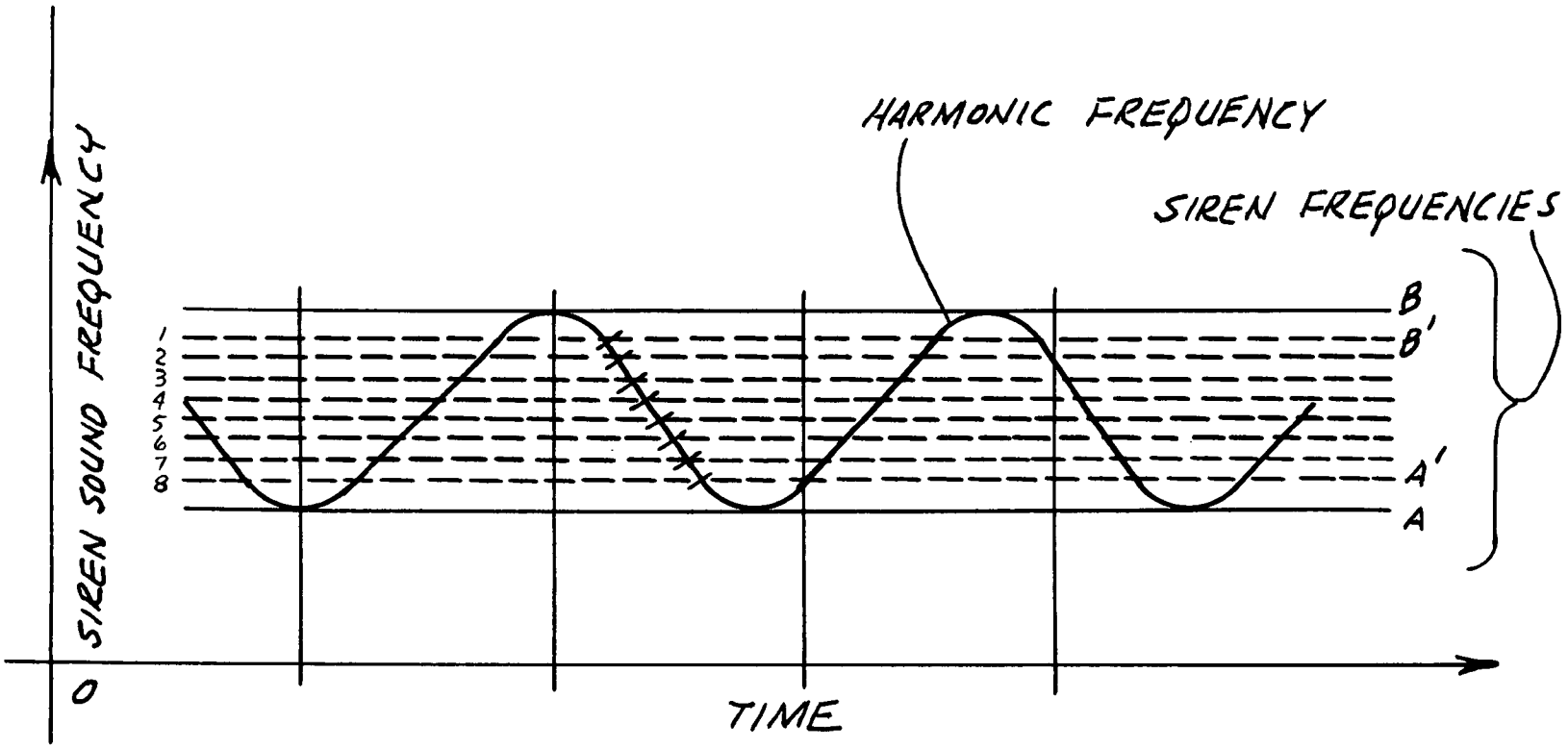
FIG. 3 is a graphical representation of siren sound frequencies A-B with selected frequencies A'-B' illustrated in dotted lines with a series of intermediate frequencies utilized for tracking a portion of a frequency signal from A' to B' incrementally to track the signal for assuring a valid siren signal has been detected, as embodied in the present invention.

At the outset it should be recognized that the siren sounds emitted by most current American sirens fall within the range of 600-1600 Hertz. This frequency range is represented in FIG. 3 by the A to B frequency range, i.e. the "low A" frequency and the "high B" frequency. The repetition rate of these siren frequencies vary, as is well known, depending on whether the siren is a "wail" or a "yelp" type of siren. The present invention eliminated the need to take into consideration the repetition rate of the siren frequencies by advantageously selecting frequencies to be processed by the siren sensor system of the present invention, identified in FIG. 3 as the A' and B' frequencies. These frequencies can be considered for the present invention as the high B' frequency being 1300 cycles per second and the low A' frequency as 900 cycles per second. The selection of these frequencies is preferable to sensing the outer limits A and B of the siren frequencies as they are more reliably representative of the siren frequencies to be sensed. Obviously, the same selection may be made for sirens operating within a different frequency band.

The present invention further recognizes that siren signals are rich in harmonics and to provide additional elimination of extraneous sounds that may cause false signals that a siren sound has been detected. To this end, the present invention has been designed to respond to a harmonic frequency B' selected to be processed and preferable the third harmonic of the siren signal to provide additional elimination of extraneous sounds and a greater degree of discrimination for the detection of the valid siren signal.

Figure 1:
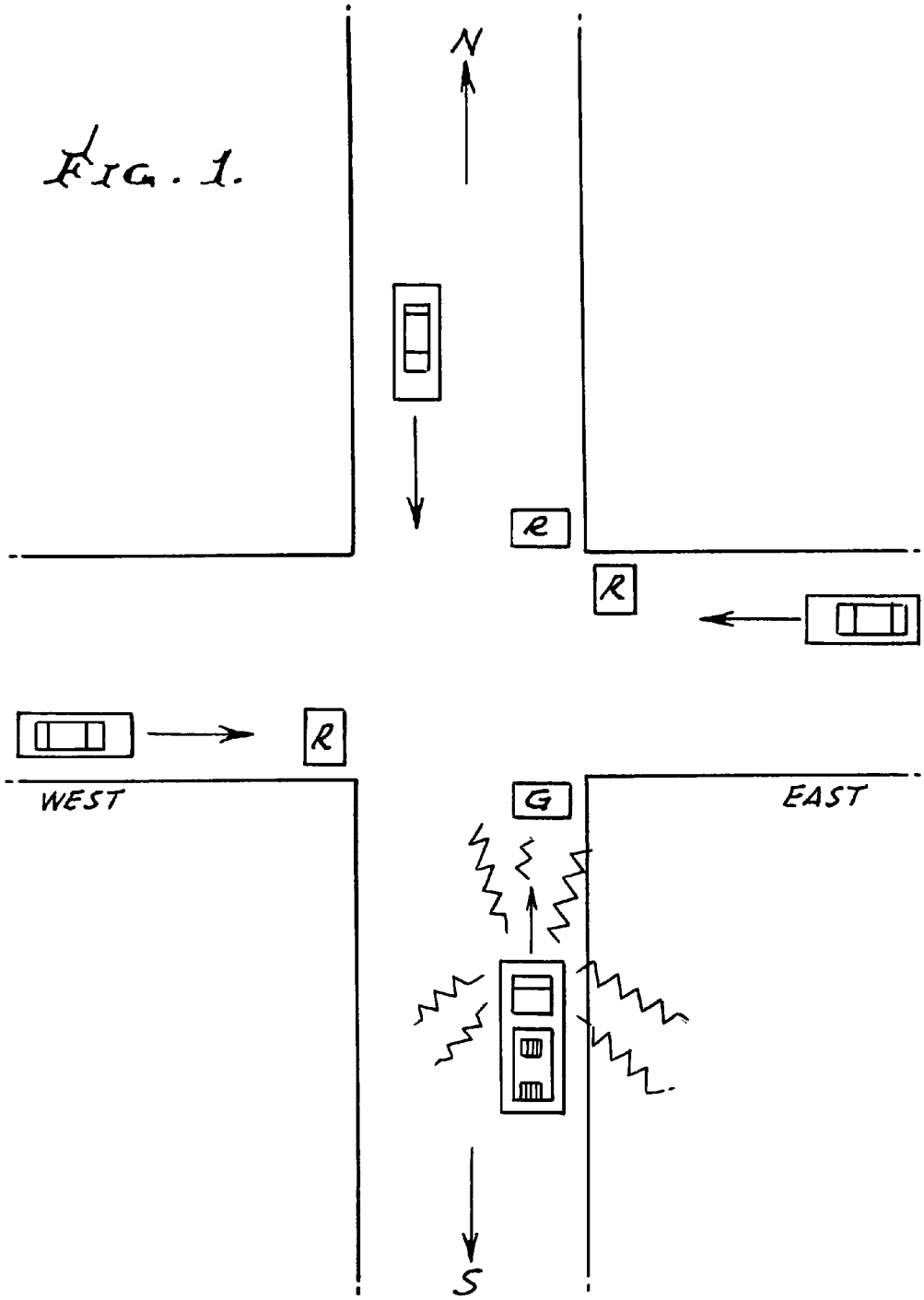
FIG. 1 is a diagrammatic view of the typical intersection of two traffic controlled roads and the condition of the traffic signals for traveling on the roads going north, south, east or west and a fire truck emitting siren sounds traveling north to the intersection.
Figure 2:
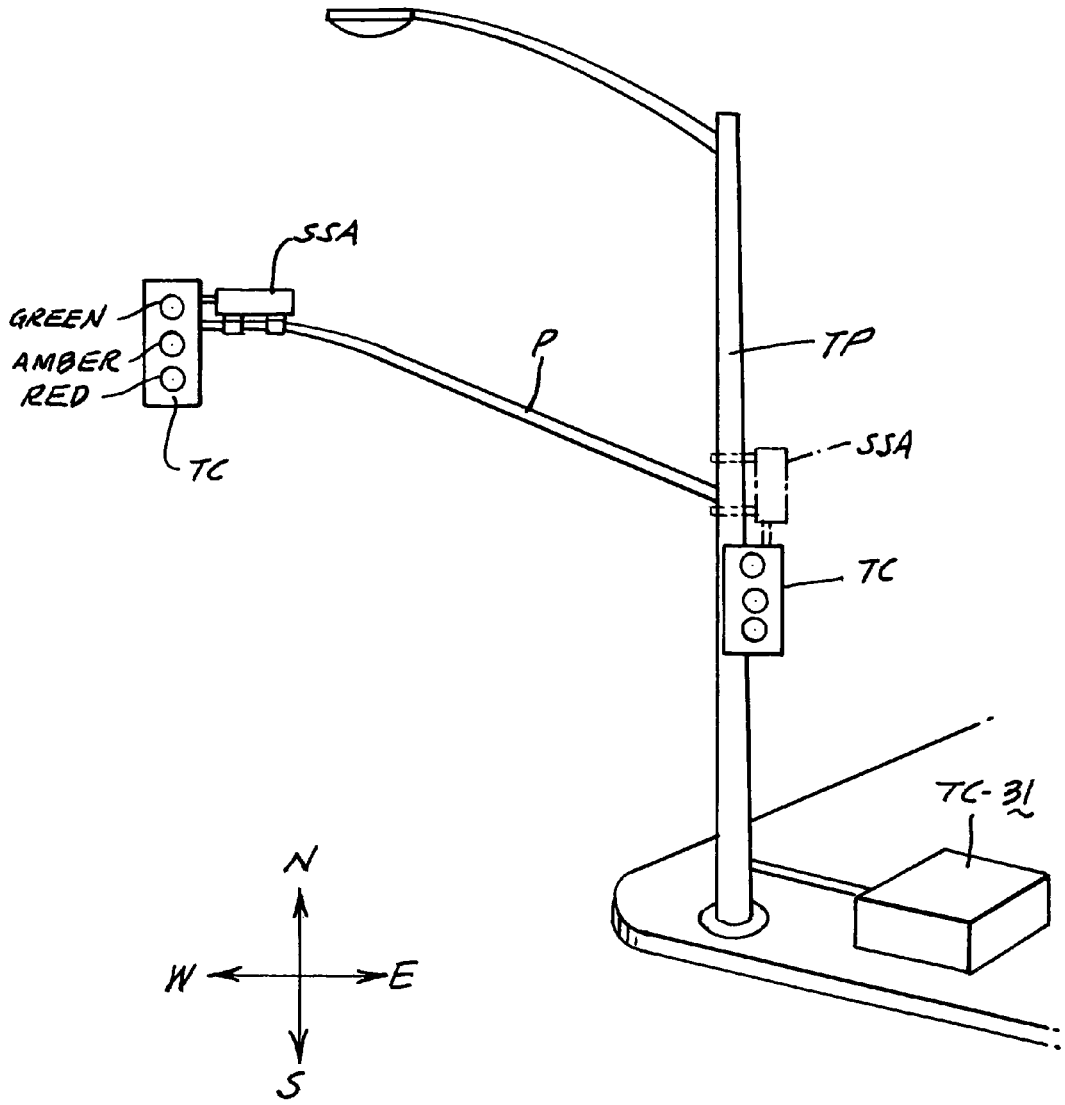
FIG. 2 is a diagrammatic representation of the mounting of traffic lights over an intersection for controlling the traffic flow with the siren sensor housing mounted to the supporting structure for the traffic lights in accordance with the present invention; and an alternate position of mounting of traffic lights at the intersection along with the siren sensor of the present invention.

Now referring to FIG. 1, the desired pattern of traffic control lights at an intersection for an emergency vehicle, in the form of a fire truck emitting a siren sound, going north to reach the intersection is illustrated. The desired pattern is a green light for the emergency vehicle with the other three lights being red so that the emergency vehicle can go through the intersection with the right of way and without interference causing the emergency vehicle to slow down from other motor vehicles. For this purpose the traffic control lights TC, the usual green red and caution signal lights may be suspended from a traffic pole TP mounted to the side of the road as illustrated in FIG. 2. A traffic light controller TC may also be mounted adjacent the traffic pole TP and is of conventional construction for sequencing the three colored signals as represented in FIG. 2. The siren sensor or assembly SSA is mounted adjacent the traffic lights TC on the cantilevered pole P with the siren sensor assembly SSA arranged to receive the siren sounds from an approaching emergency vehicle traveling in a northerly direction as represented in FIG. 1. Alternatively, the traffic lights TC may be mounted to the vertical pole TP along with the siren sensor assembly mounted to the pole TP adjacent thereto. In some situations traffic lights TC may be suspended over the road and also on the traffic pole TP as illustrated in FIG. 2.

The present invention detects the siren sound signals by means of an acoustic horn-microphone combination for each corner of the intersection for monitoring the siren sounds with the microphone of an acoustic horn for receiving the approaching siren sounds on axis with the siren signals and as a result will provide a dominant signal level effective to sense the direction of the sound emanating from an emergency vehicle's siren. The number of acoustic horn-microphone combinations is a matter of choice. A four in one intersection system and its four horn array is disclosed in the aforementioned provisional application and the entire disclosure thereof is incorporated herein by reference.

Figure 4:
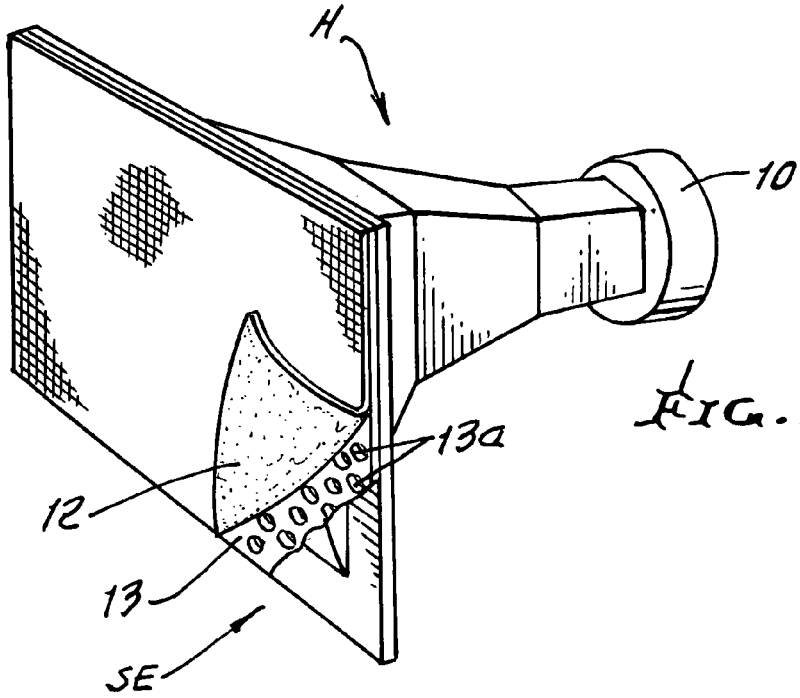
FIG. 4 is an acoustic horn modified for the purposes of the present invention for processing audio signals therein and a portion of the cover for the sound receiving aperture pulled back to show the covering and the associated supporting plate, therefore.
Figure 5:
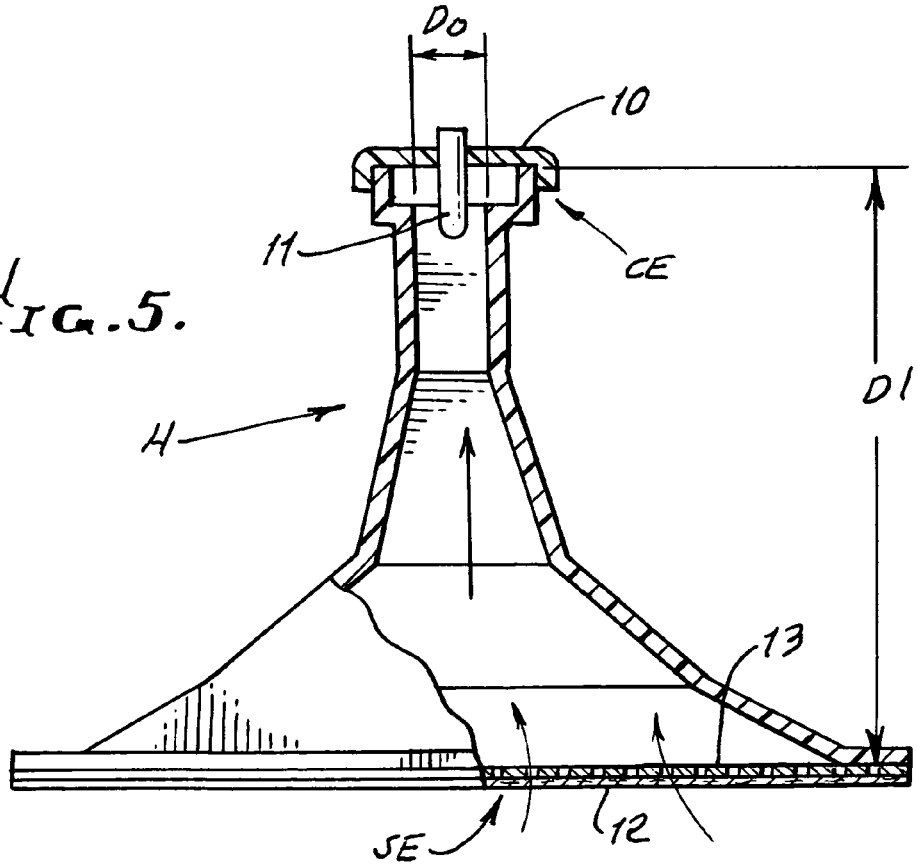
FIG. 5 is a partial cross-sectional view of the acoustic horn of FIG. 4 with a portion illustrated broken away and mounting a microphone in the horn at the top end as illustrated in FIG. 5.

One of the unique and important features of the present invention is the means for receiving the siren sounds and converting the siren sounds into corresponding electrical signals to be processed that aids in the elimination of all other extraneous sounds from being introduced to the electronic signal processing circuitry for validating the detection of a siren signal. For the purposes of the present invention a commercially available acoustic horn is modified to function as an acoustic lens which is the reverse of the purpose it was designed for. An acoustic horn that is suitable for use with the present invention is the Model PMBTW515 manufactured by Pyramid Car Audio, Inc. of 1600 63$^{rd}$ Street, Brooklyn, N.Y. 11204. The detached acoustic horn H modified in accordance with the present invention is best appreciated by viewing FIGS. 4 and 5 along with the siren sensor housing in FIGS. 6 and 9. The illustrated acoustic horn H is constructed and designed with a cone like shape having one open end or the large open end SE for receiving sound waves in a pre-selected frequency range. The opposite end of the horn H or the end opposite the end SE is a smaller end CE and is provided with a 1 closure 10 for closing off the normally open end CE. The closure 10 is a cup shaped cap adapted to be readily secured to the end CE. As can be readily appreciated from examining FIGS. 4 and 5 the horn H tapers from the large end SE to the end CE and is sized for receiving a pre-selected range of siren sound frequencies, namely the 600 to 1600 Hertz range. The opening SE for receiving the sound waves has a dimensional Di, as noted in FIG. 6, or a length of 9¼ inches and a height, Dih of ¾ of an inch. The outside dimension of the horn H proper or the dimension Dl illustrated in FIG. 5 is 5½ inches. The inside dimension of the throat of the horn is identified as Do is one inch; see FIG. 5.

Figure 9:
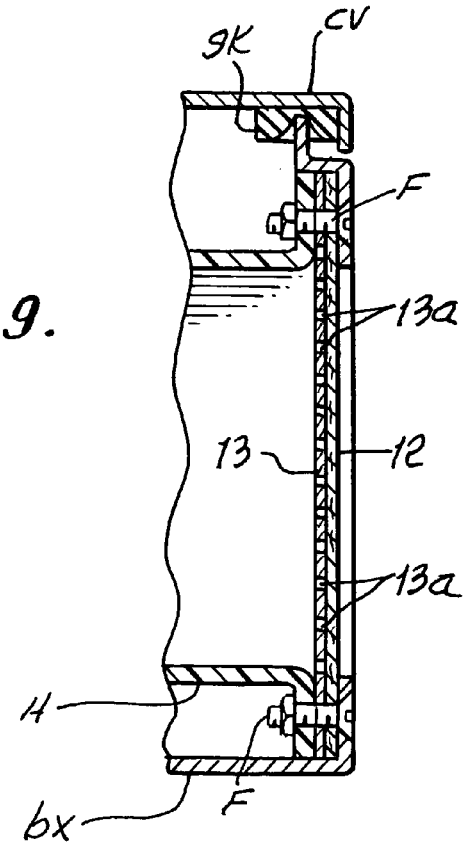
FIG. 9 is a cross-sectional view taken along line 9-9 of FIG. 8, of the details of the closure means for the sound receiving opening for the acoustic horns as secured to the siren sensor housing and illustrating the housing top lid closed.

The focal point of the horn H is located adjacent the closed end CE of the horn H. A microphone 11 is mounted within the horn H facing the sound receiving end SE. The microphone is preferably suspended in the horn H at the focal point, as illustrated. The microphone 11 may be any known type of microphone for the purposes of the present invention although an electret condenser type of microphone is described hereinafter. The acoustic horn H is used as an acoustic lens. With the microphone placed at the focal point of the horn H, the lens effect of the horn filters and amplifies the sound frequencies in the range of the siren signals. This arrangement eliminates all other extraneous sound from being coupled to the electrical signal processing circuitry. When the horn H is utilized to control the traffic control lights it is exposed to all of the environment including the detrimental factors such as moisture, which may be in the form of rain, and/or snow, wind, dust, etc, To prevent these environmental factors from entering the horn H by means of the sound entering end SE, a weather proof fabric 12 is used to close the end SE. A fabric that has been found suitable for this purpose is one manufactured by Seattle Fabrics of 8702 Aurora Avenue North, Seattle, Wash. 98103, their model Ultrex 3435. In order to give the fabric 12 proper support, a perforated supporting plate 13 is secured to the end SE of the horn H by a pair of spaced fasteners F as best illustrated in FIG. 9. The plate 13 has a multiplicity of apertures 13*a* over its entire surface covered by the fabric 12 for permitting the sound waves to enter the horn while the fabric prevents any of the detrimental factors from moving inside the horn.

Figure 7:
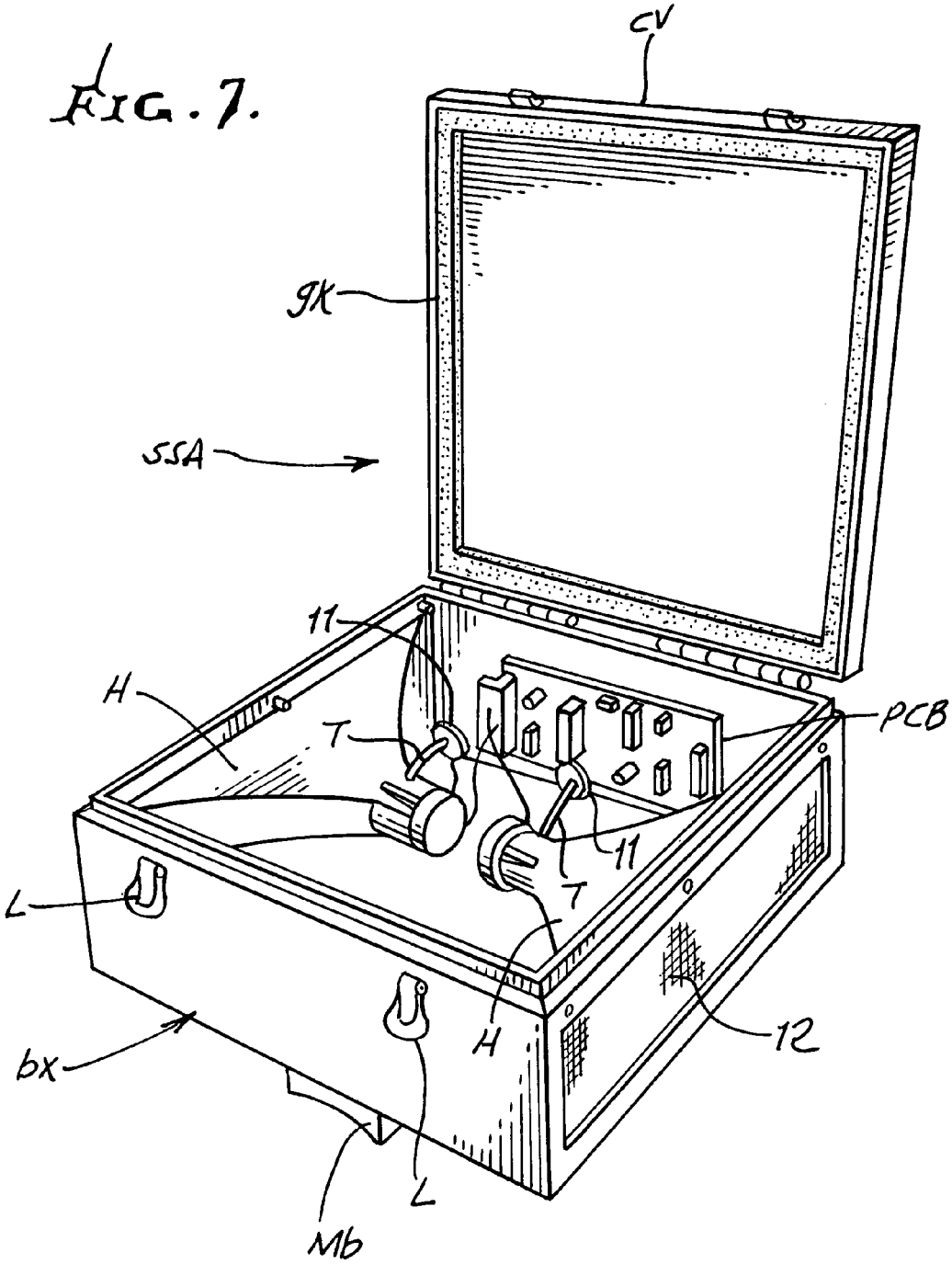
FIG. 7 is a perspective view of a siren sensor housing, in an open condition, illustrating a pair of acoustic horns mounted therein with the acoustic siren sensor detecting circuitry mounted on a printed circuit card.
Figure 8:
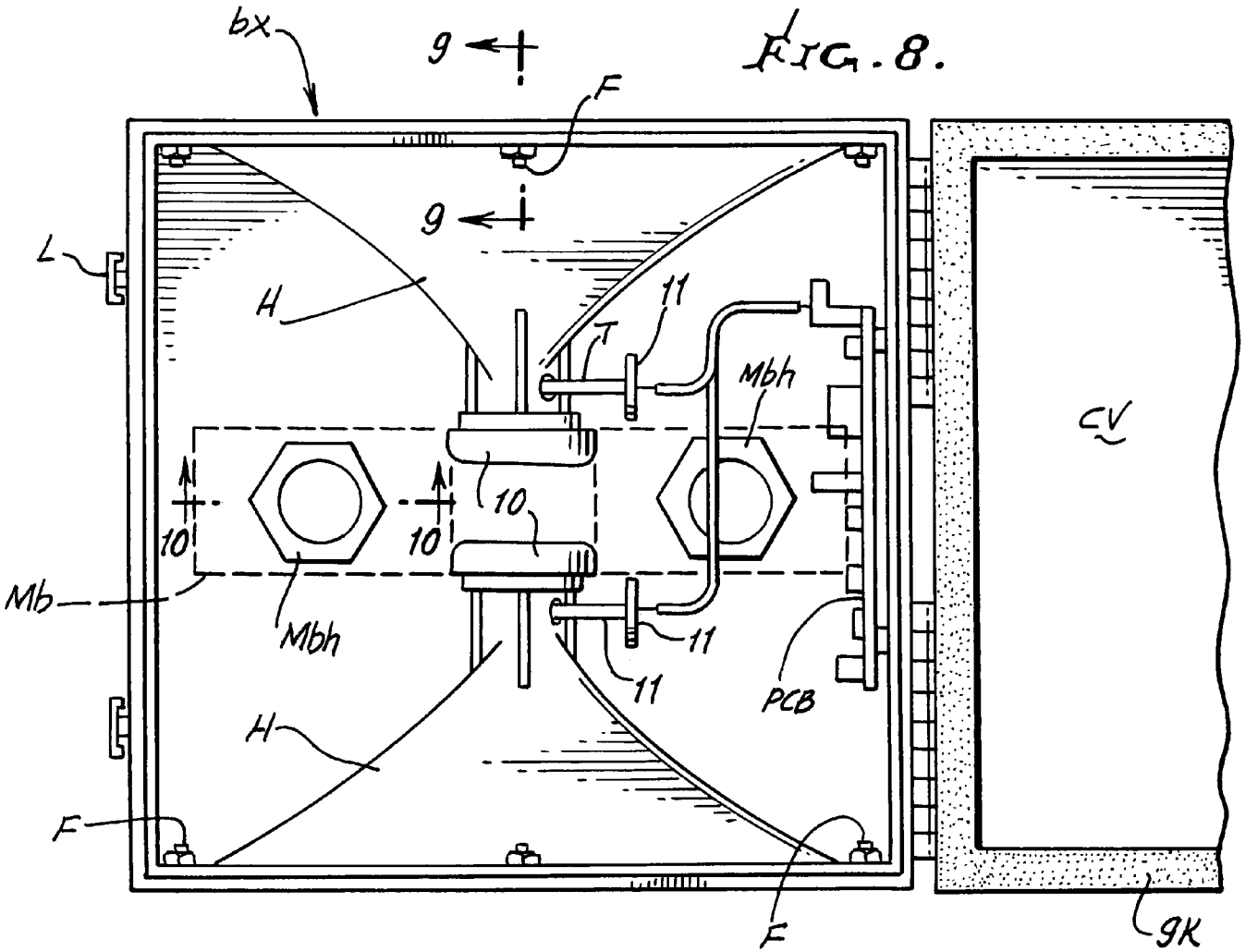
FIG. 8 is a top plan view of the open, siren sensor housing, looking into the housing as illustrated in FIG. 7, with an alternate arrangement of the microphone for the two acoustic horns outside of the horns and illustrating the location of the housing mounting brackets in dotted outline.

Although, the mounting of the microphone inside the horn H at the focal point of the horn, an equivalent structure for gathering the sound at the focal point such as illustrated in FIG. 7 may be employed. As illustrated a sound conveying tube T mounted to receive the sound at the focal point of the horn H to outside of the horn with the end of the tube having a microphone 11 secured thereto for providing the electrical signals representative of the sound waves.

It should now be appreciated that the acoustic H-microphone 11 assembly is a complimentary acoustic electronic combination that provides a tuned and directional audio sensor. As opposed to merely giving a warning signal to a motor vehicle operator, the direction of travel of an emergency vehicle sounding a siren is necessary to detect for correctly controlling traffic light signals. In accordance with the present invention, each acoustic horn-microphone assembly is provided with an individual pre-amplifying means and siren sensing electronics illustrated in the form of a printed circuit board PCB in FIG. 7 and will be described in detail hereinafter.

Figure 12:
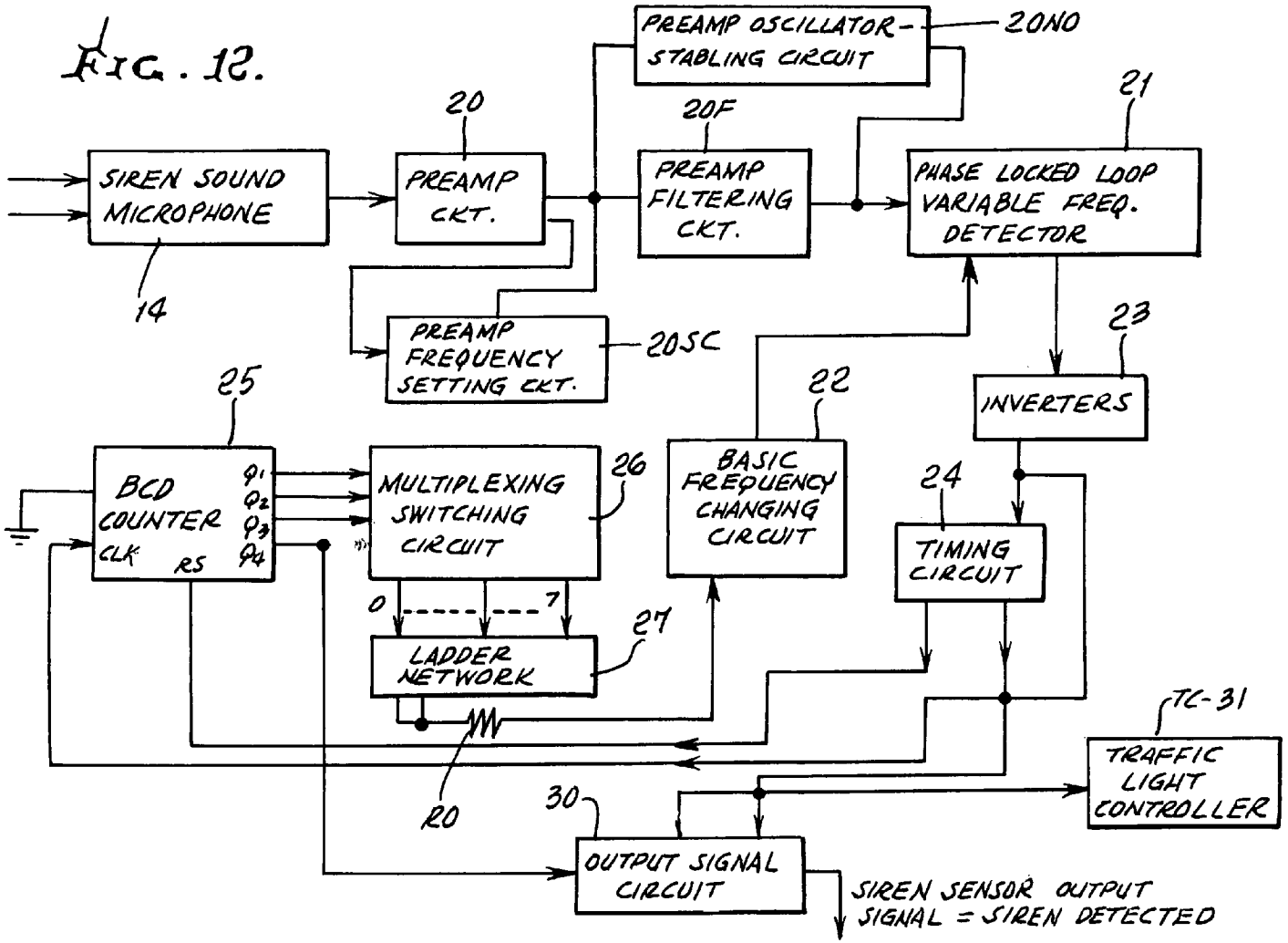
FIG. 12 is a block diagram of the electronic processing circuitry for validly detecting a siren sound utilized in combination with a conventional traffic light controller.

Now referring to FIG. 12, the general organization of the siren sensing and processing circuitry for processing the siren sound microphone signals from a single acoustic horn-microphone will be examined. The siren sound signals represented by the microphone 11 output signals and any other spurious sound signals are coupled to a pre-selected number of pre-amplifying circuits 20. The amplifying circuits 20 amplify and filter out unwanted frequencies and couple the filtered signal to the phase locked loop, variable frequency detector 21. The pre-amplifier circuit 20F coupled to the phase locked loop detector circuit 21 is uniquely configured to function as a frequency band pass filter over the entire siren frequency range with an extremely high Q. This pre-amplifier 20F is configured to oscillate at a frequency which is above the siren sound spectrum such as 1800 Hertz and defines the filtering feature that allows only sound in the siren sound spectrum to pass through the oscillator. The pre-amplifier 20F has its input circuit coupled to a frequency setting circuit 20SC for defining the 1800 Hertz and an oscillator stabilizing circuit 20NO coupled between the amplifier input and output circuits to prevent the amplifier 20F from going into oscillation by causing the input signal to lag the output signal. The removal of the stabilizing circuit 20NO will cause the amplifier 20F to go into oscillation.

The phase locked loop detector 21 is preferably set by a basic frequency changing circuit 22 to a frequency of the third harmonic of siren signals to provide additional elimination of extraneous sounds and a greater degree of discriminate detection of the siren signal. Upon the detection of a siren signal of a frequency determined by the frequency changing circuit 22 the detector is locked on to the frequency and an output signal is provided by the detector 21. The initial frequency defined by the frequency changing circuit is defined at the high end of the siren frequencies. The inverter circuits receive and shape the detector output signal to initiate a timing circuit 24 and to enable a binary coded decimal counter 25 to count. The timing circuit 24 is set for a specific interval for the detector circuit 21 to recognize and detect the siren. When the detector 21 falls out of a frequency lock as the siren signal cycles to a lower frequency, a count signal is coupled to the BCD counter to count up one decimal count. If this process is not complete before the timing circuit 24 times out, the counter 25 will be reset to a zero count and the detector circuit will be reset.

If the lock-unlock of the detector 21 occurs during the time window of timing circuit 24, the counter 25 will count up one count. The counter 25 is set to count up a maximum of eight binary coded decimal counts. The output of the counter 25 in terms of four binary bits are represented by the output terminals Q1, Q2, Q3, and Q4. The Q1, Q2 and Q3 outputs are coupled to a multiplexing switching circuit 26 that provide a single decimal signal representative of a BCD count. The output of the switching circuit has 7 individual outputs that are coupled to a resistor ladder network 27. The zero count of the counter 25 is connected to the zero resistor or the R0 resistor which is continuously connected to the frequency changing circuit 22 defining the high end of the frequency spectrum. The resistors of ladder network 27 are serially connected to the resistor R0 and are serially connected thereto to change the frequency for locking up the detector 21 as the input siren signal decreases in frequency. The binary coded bits representative of the 8 decimal counts and the resistors that are combined at each count are as follows:

BCD Counter—8 BCD Counts

| Outputs Count | Q1 $2^0$ | Q2 $2^1$ | Q3 $2^2$ | Q4 $2^3$ | Count | Ladder Network Resistor |
|---|---|---|---|---|---|---|
| 0 | 0 | 0 | 0 | 0 | 0 | $R_0$ |
| 1 | 1 | 0 | 0 | 0 | 1 | $R_0 + R_1$ |
| 2 | 0 | 1 | 0 | 0 | 2 | $R_0 + R_1 + R_2$ |
| 3 | 1 | 1 | 0 | 0 | 3 | $R_0 + R_1 + R_2 + R_3$ |
| 4 | 0 | 0 | 1 | 0 | 4 | $R_0 + R_1 + R_2 + R_3 + R_4$ |
| 5 | 1 | 0 | 1 | 0 | 5 | $R_0 + R_1 + R_2 + R_3 + R_4 + R_5$ |
| 6 | 0 | 1 | 1 | 0 | 6 | $R_0 + R_1 + - - - R_5 + R_6$ |
| 7 | 1 | 1 | 1 | 0 | 7 | $R_0 + R_1 + - - - R_5 + R_6 + R_7$ |
| 8 | 0 | 0 | 0 | 1 | | |

The counter 25 outputs Q1, Q2, Q3, and Q4 represent the binary values as follows;

Q1=$2^0$
Q2=$2^1$
Q3=$2^2$
Q4=$2^3$ reading the decimal counts above, left to right. It will be noted that count 8 of BCD counter 25 is not connected to the ladder network 27 but directly to output signal circuit 30 and to a conventional traffic light controller 31 TC provide the siren sensor signal for obtaining the traffic light pattern at the intersection as illustrated in FIG. 1. The output signal circuit 30 may be a static flip-flop circuit, for example.

Decimal count 8, in terms of the binary outputs Q1, Q2, Q3, and Q4 is 0001, reading left to right, and provides the siren signal for causing the output circuit 30 to change state for signaling the conventional light controller 31.

Figure 13:
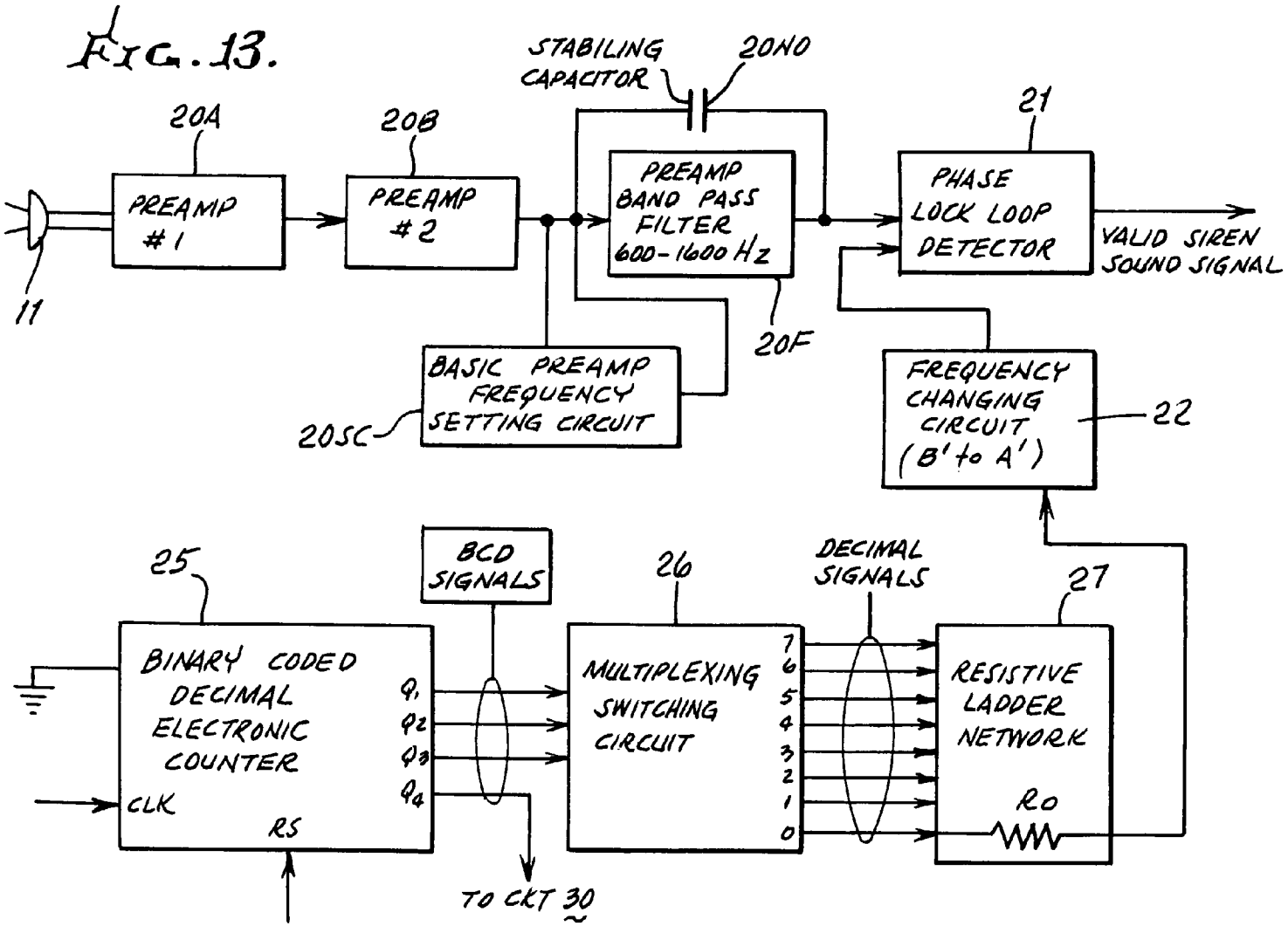
FIG. 13 is a block diagram of the details of the electronic processing circuitry of the circuitry for processing a portion of a detected siren sound for assuring the detection of the siren sound signal is a valid siren sound signal.

Now referring to the block diagram of FIG. 13 an examination of the tracking of the siren sound frequency as illustrated in FIG. 3 will be examined. As illustrated in FIG. 13, three pre-amplifiers 20A, 20B, and 20F are illustrated for amplifying the electrical output signal from the microphone 11. At this point it will be appreciated by those skilled in the art that the electronic processing system of the present invention is preferably utilized with the acoustic-horn-microphone combination as described hereinabove but also may be used with just a microphone for detecting the siren sound signals.

Figure 18:
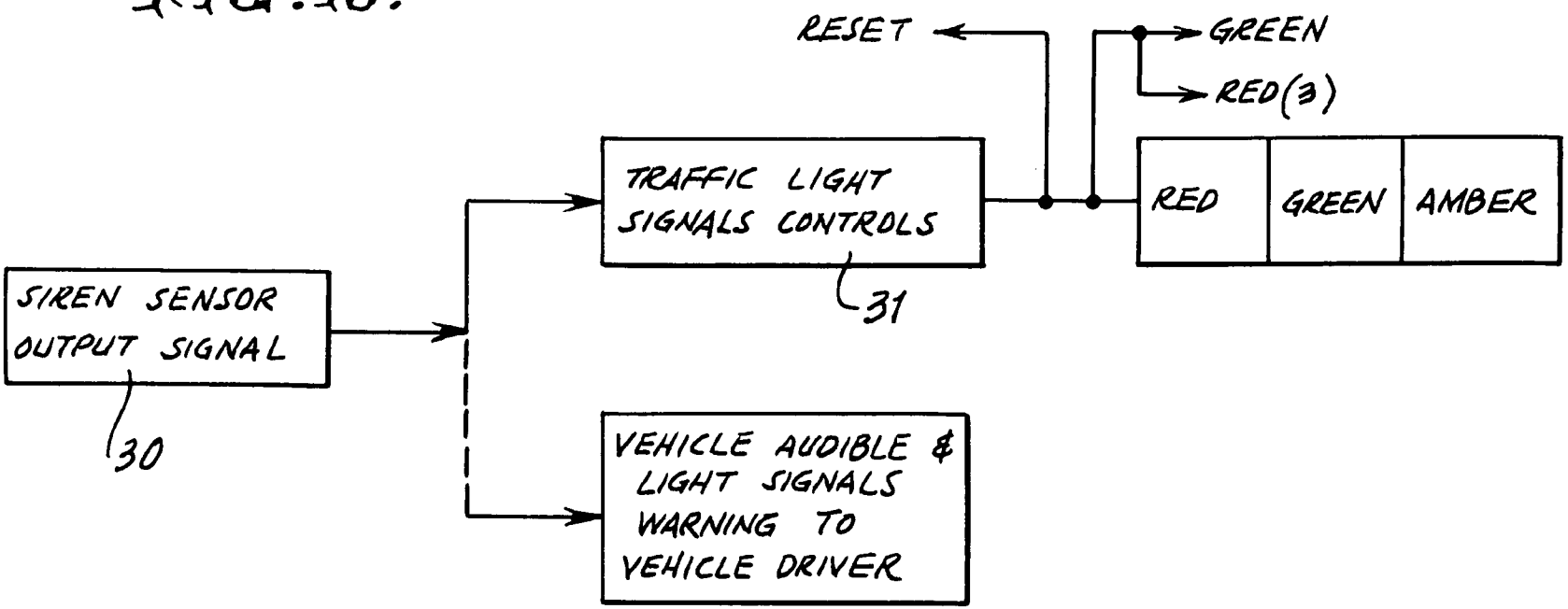
FIG. 18 is a block diagram of the alternate uses of the siren sensor output signal from the siren sound processing circuits for use as either controlling the traffic signal light control or a warning signal to a vehicle driver in either an audible or light warning signal.

The amplifiers 20A and 20B operate in a conventional fashion for amplifying the microphone electrical output signal while the pre-amplifier 20F is constructed and defined to function as a band pass filter for the siren frequencies 600-1600 Hertz. The amplifiers are designed to afford the maximum sensitivity to the frequency spectrum of the siren sounds and all three amplifiers amplify the microphone output signal. Amplifier 20F limits the frequency band along with frequency setting circuit elements 20SC. As illustrated in FIG. 13, the oscillator stabilizing circuit 20NO is a capacitor for suppressing the amplifier 20F from going into oscillation. Accordingly, the band pass filter signals coupled to the amplifier 20F are the only signals coupled to the phase locked loop detector 21. The frequency changing circuit 22 is coupled to the input circuit for the detector 21 for changing the frequency of the detector for tracking a portion of the siren sound frequency as it decreases from frequency B to frequency A. the circuit is operative to track the siren sound frequency from high B' frequency corresponding to the count one of the electronic counter 25. The counter 25 is designed to count and follow the decreasing siren frequencies by timing and counting each time the phase locked loop detector 21 locks onto a frequency and unlocks the detector as the frequency decreases. As illustrated in FIG. 3, the incremental siren frequencies that are tracked in the frequency decrease from Frequency A' to B' correspond to the electronic counter counting up from one to 8. After count one is registered due to the unlocking of the detector 21, the circuit is effective through the multiplexing circuit 26 and the ladder network 27 to add additional resistance in series with the resistor R0 to the frequency changing circuit 22 to define another siren frequency immediately below the B' frequency, as illustrated in FIG. 3, to lock up the detector 21 at this reduced frequency signal. When the siren frequency decreases below the frequency selected by a decimal count one and the detector 21 unlocks a further count signal derived from the output signal of the detector, will count up the counter 25 to count two. Count two, four binary bits coupled to the multiplexing circuit 26 will select a further resistor, resistor R2 to be serially added to resistors R0 and R1 of the ladder network 27, for defining a siren frequency for count 3. It will be appreciated that each incremental change must occur during the time window of circuit 24 or the sequence will be interrupted by exceeding the time window and the counter 25 set to the zero count. Accordingly, assuming the incremental changes occur so the locking and unlocking cycles of the detector 21 during the time window of circuit 24, the tracking is processed through counts 2 through 8 at each lower siren frequency and the frequency of the phase locked loop detector 21 is changed until count 8 is reached. At this last count, the Q4 output signal is coupled directly to the output signal circuit 30 for signaling a valid siren signal has been detected. As illustrated in FIG. 18, once the siren signal has been verified, the detector 21 output signal can be utilized to control the traffic signal lights or to provide a warning signal to a motor vehicle driver of an approaching siren sounding emergency vehicle.

Figure 17:
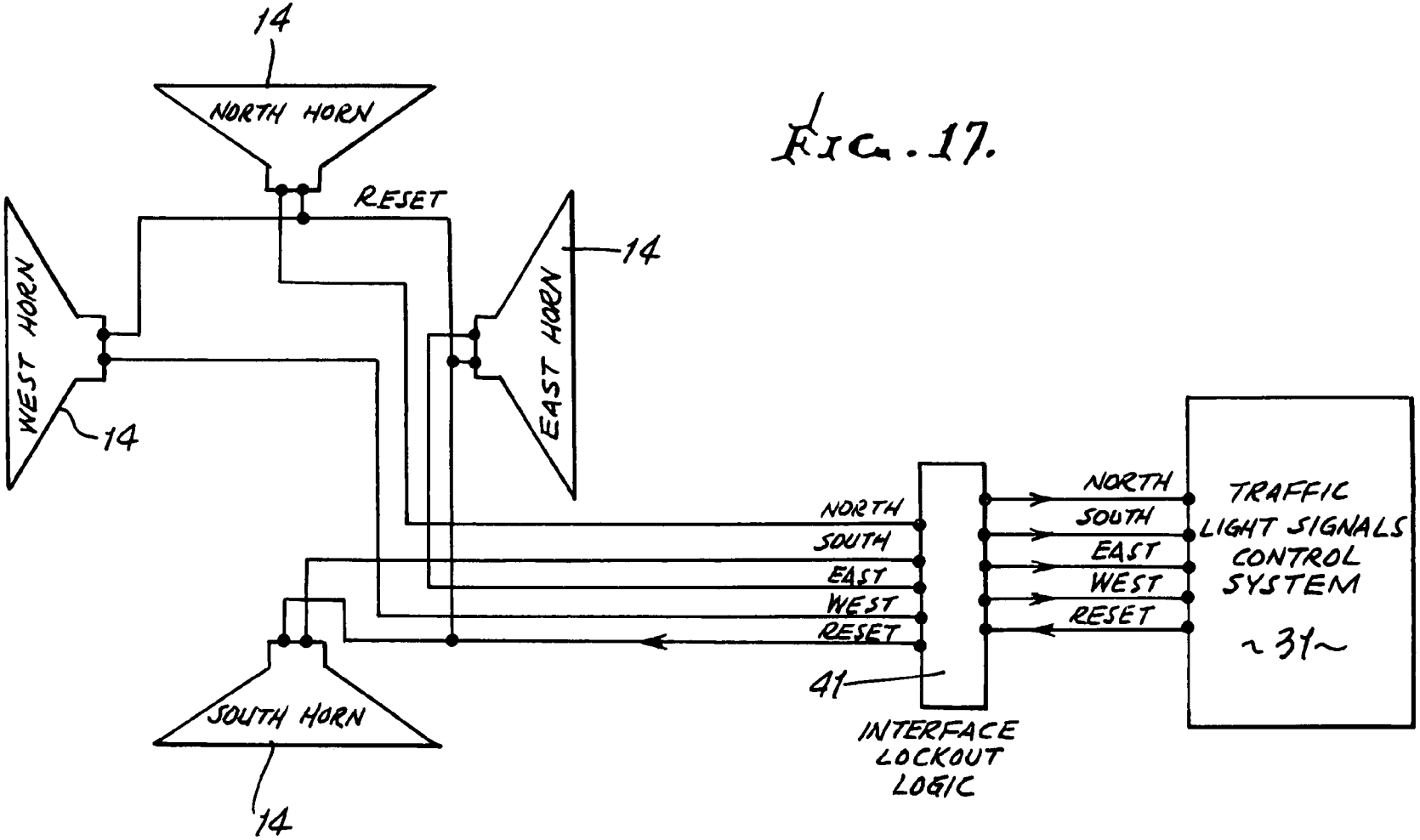
FIG. 17 is a siren sensor one acoustic horn block diagram of the interface lock out logic with a conventional traffic light signals control system.

With the above operation of a single acoustic horn-microphone combination in mind, the operation to affect a right of way for a siren sounding emergency vehicle will be further examined. Assuming a conventional traffic light controlled four corner intersection as illustrated in FIG. 1, a single acoustic horn-microphone combination and the associated printed circuit board mounting the electronic signal processing circuits of the present invention are mounted adjacent each corner of the intersection to detect siren sounds from vehicles traveling north, south, east and west. The siren sensor assembly may be mounted to a traffic light pole in the manner illustrated in FIG. 2. The siren sensor mounted on the south east corner of the intersection with the horn H opening Se arranged so as to intercept the sound waves emitted by the emergency vehicle traveling north to the intersection as represented in FIG. 1. Similarly a siren sensor assembly is mounted adjacent each corner of the intersection with the horn H opening Se arranged to intercept sound of an emergency vehicle traveling south, east, and west. In a typical four way intersection, each horn-microphone siren sensor is facing 90 degrees apart from each other; see FIG. 17. Since the siren sensor assembly on the south east corner is aligned axially with the emergency vehicle it will have a dominant level of signal coupled from its acoustic horn-microphone assembly and is coupled to the siren sensor signal processing circuits. The output signal from the dominant siren sensor assembly will lock out the other three siren sensor assemblies. This output signal from the dominant siren sensor assembly provides an appropriate switch closure or similar signal for the traffic light signal control system 31. With the signaling of the detection of a valid siren signal from the dominant siren sensor assembly the traffic light control system 31 will control the traffic light signals to provide a "green" signal for the emergency vehicle to travel through the intersection while a red signal will be provided at the other 3 corners, as represented in FIG. 1. The dominant siren sensor assembly will remain in its triggered state until the control system 31 provides a reset signal to all of the sensor assemblies through the interface lockout logic circuit 41, as represented in FIG. 17. At this point it should be appreciated by those skilled in the art that the fact that the electronic processing circuit described hereinabove is designed to track, incrementally, a portion of the siren sound signal so that each incremental change occurs within a pre-selected time period and a sufficient number of increments are defined by the processing circuitry, it assures that a valid siren signal has been detected and the traffic light controller 31 can reliably provide an emergency vehicle the desired right of way through the intersection. Also, as seen by viewing FIG. 18, this siren signal output may be utilized to provide a motor vehicle operator a reliable warning of an approaching emergency vehicle, as will be made more evident hereinafter.

Figure 14A:
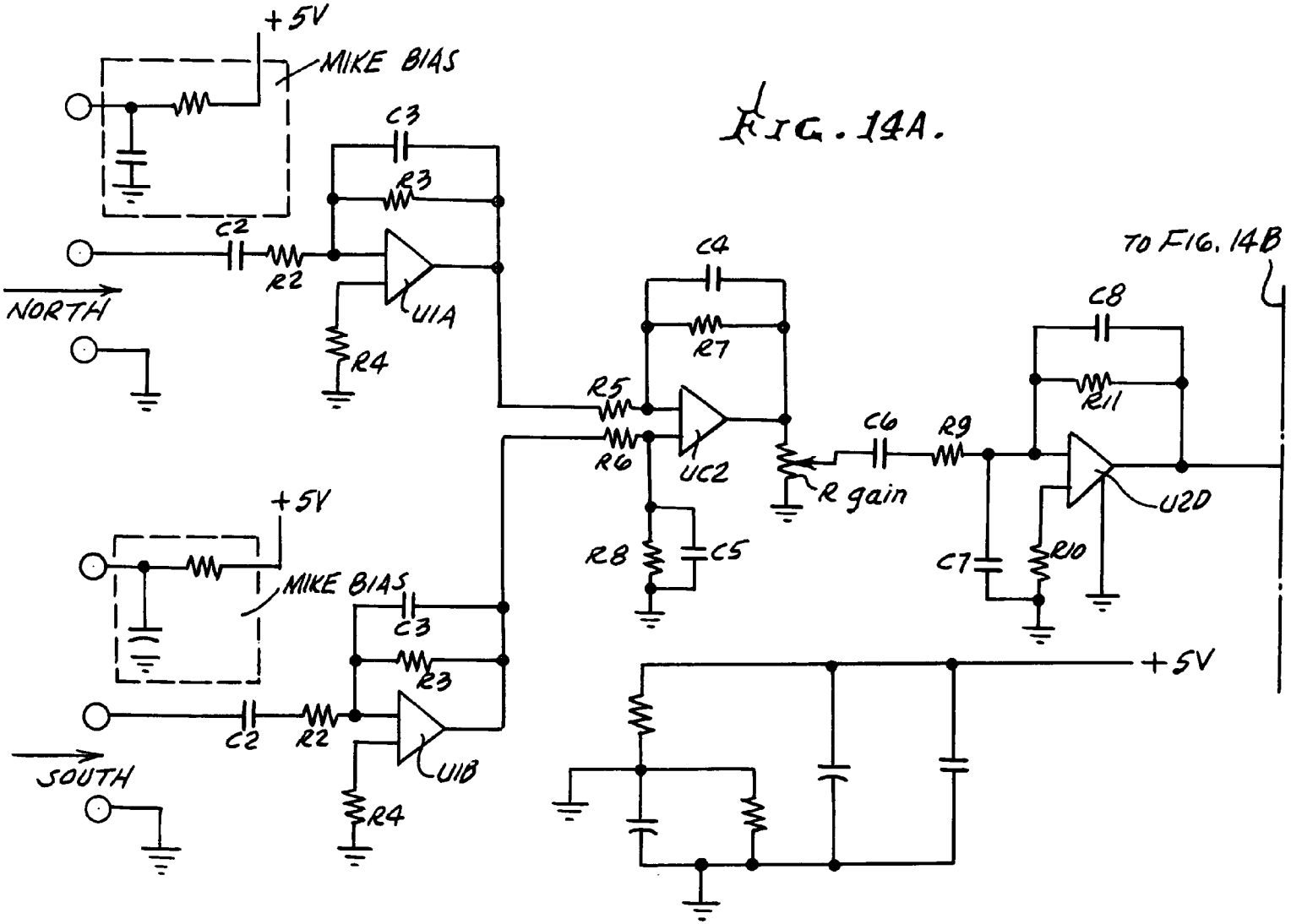
FIGS. 14A, 14B and 14C, taken together are a schematic circuit diagram of the electronic processing circuitry for the siren signals along with other environmental sounds, derived from a pair of acoustic horn-microphone combinations embodying the present invention.
Figure 14B:
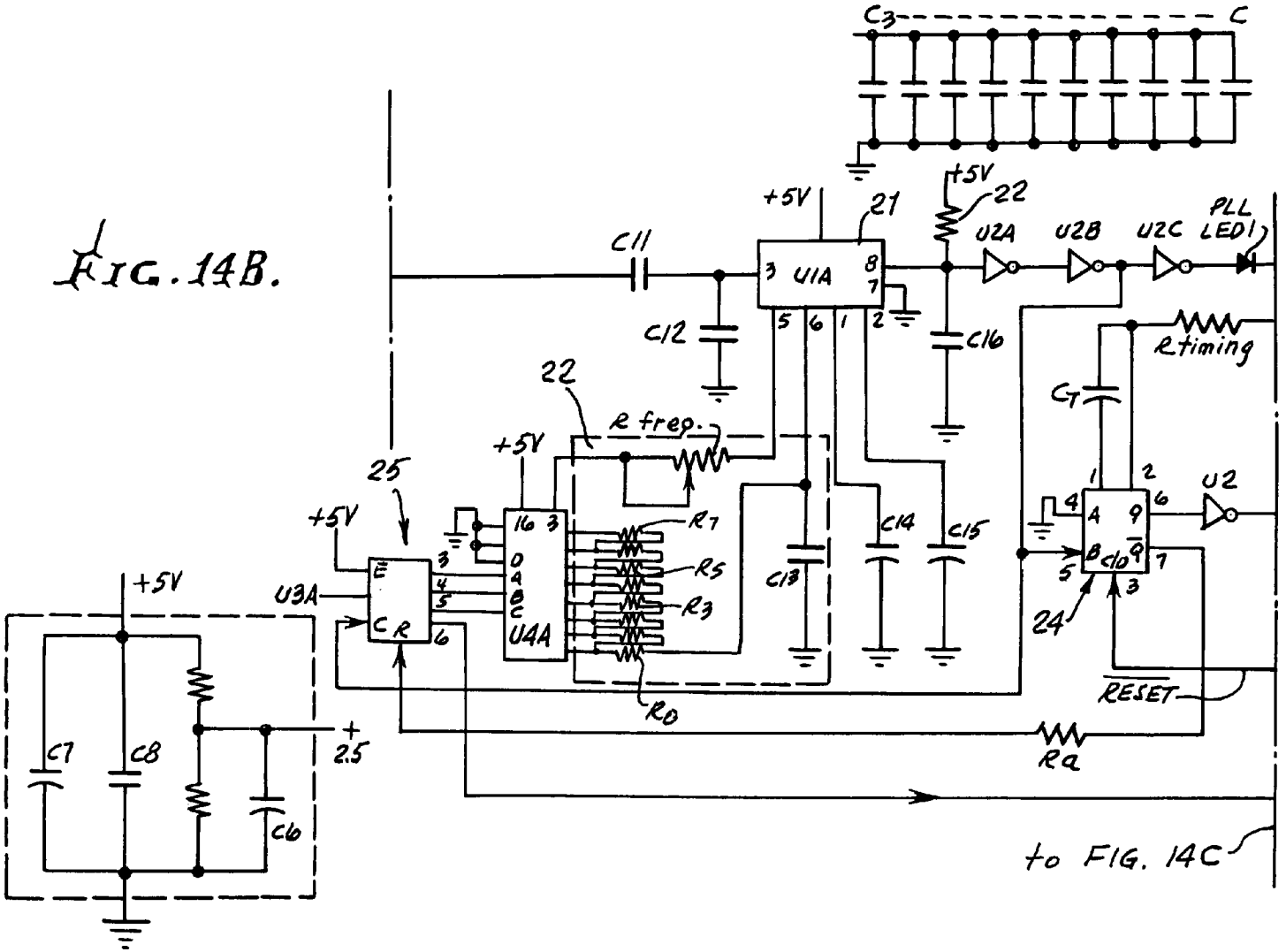
Figure 14C:
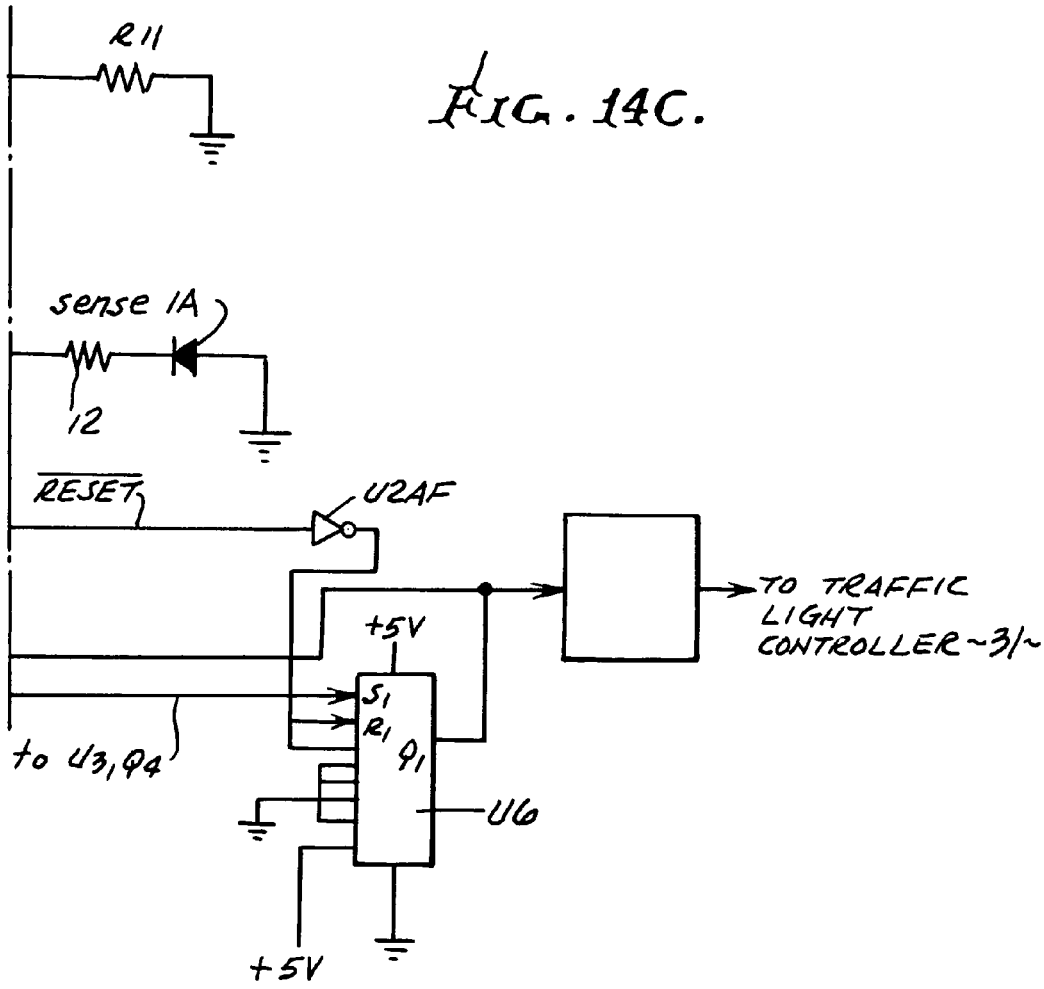

Now referring to FIGS. 14A, 14B and 14*c* taken together, the detailed circuit diagram will be examined with the above described in mind. At the outset it should be understood that each electronic component is commercially available integrated circuit package that has been modified and combined in accordance with the concepts of the present invention. FIG. 14A illustrates the siren sensor pre-amplifier configuration for a two acoustic horn-microphone combination arranged in a north-south configuration with the output signals from the north and south microphones being coupled to individual pre-amplifiers. The north microphone output signal is coupled to amplifier U1A and the south microphone output signal is coupled to the input circuit for amplifier U1B. Due to the use of an electret condenser microphone each microphone is provided with an individual microphone biasing circuit comprising the resistor R1A and C1 coupled to a +5 volt source and illustrated in a block defined by a dotted outline. The amplifiers U1A and U1B may be high gain, frequency compensated operational amplifiers of the type available from Texas Instruments Incorporated of Dallas, Tex., namely model LM324 integrated circuit package having four amplifiers in a package. The input circuits for these amplifiers have a Resistance-Capacitor network to assure maximum sensitivity to the frequency spectrum of the siren sensors. This network comprises input component C2, R2, C3, R3, and R4. Each amplifier U1A and U1B have a feedback loop between their input and output circuits consisting of a parallel circuit network of a resistor and capacitor. The resistor R3 and capacitor C3 for U1A and resistor R3 and capacitor C3 for amplifier U1B. The output signals from pre-amplifiers U1A and U1B are coupled to amplifier UC2 to be summed together out of phase so that the output signal from UC2 will be the difference between the two output signals of U1A and U1B. The siren signals that are on axis with a microphone will add together and those off axis or perpendicular will cancel each other out. The siren sounds arriving on axis will be dominant in signal strength and will provide the necessary directional information of the siren sounds. The output signal from amplifier UC2 which is the same integrated circuit package as preamplifiers U1A and U1B provides additional signal amplification. The output signal from amplifier U1A is coupled to one input terminal for U2C by means of a resistor R5 while the other signal is coupled to another terminal through resistor R6. The capacitors C3 for the respective amplifier U1A and U1B in their feedback loops are utilizing to filter out high frequency signals. Similarly, the parallel network of capacitor C4 and R7 coupled between the output circuit for amplifier U2C and the input terminal in common with resistor R5 while the other input terminal is coupled in common with the resister R6 and resistor R8 to ground with the parallel capacitor C5 to ground. The output signal of amplifier UC2 is coupled through a variable resistor Rgain to ground. The output signal from amplifier UC2 is further amplified and frequency band limited by amplifier U2D and associated components C6, C7, R9, and R10. The element U2D also has a feedback parallel network of the capacitor C8 and resistor R11. The outpost signal of U2D is coupled to a phase lock loop (PLL) detector U1A; see FIG. 14B. The amplifier U2D is the integrated circuit package LM324 of Texas Instruments as described hereinabove.

The phase lock loop (PLL) detector U1A is a variable frequency detector having a voltage controlled oscillator as is available from National Semiconductor Corporation, the model LM-567 Tone Decoder and is so illustrated in FIG. 14B. the signal provided by amplifier U2D is coupled to the input terminal of detector U1A by means of a serial capacitor C11 in common with the capacitor C12 having its other terminal connected to ground.

The frequency changing circuit 22 for the detector 21, U1A, comprises the combination circuit elements R0 of the ladder network 27, capacitor C13 coupled to terminal number 6 of U1A and ground, and the variable resistor Rfreq having one end of the resistor connected to terminal number 5 of U1A and the other terminal to the switching circuit 26. One end of the ladder network resistor R0 is coupled between terminal number 6 of U1A in common with the ungrounded terminal of capacitor C13 with the other terminal connected to switching circuit 26. Terminal 1 and 2 of U1A are individually coupled to ground through capacitors C14 and C15 respectively as illustrated. Terminal 8 of element 21 is the output signal terminal number 7 connected to ground.

The frequency changing circuit 22 comprising the above described circuit elements functions in combination with the binary coded decimal counter 25 and the multiplexing switching circuit 26 and the resistance ladder network 27. The electronic counter 25 may be the integrated circuit package of Texas Instruments model CD4518B, the CMOS Dual Up-Counters. The counters 25 counts up to a maximum decimal count of 8 for the purposes of the present invention. In the single unit operation the ENABLE input is maintained in a high state by a connection to a plus 5 volt source, as illustrated in FIG. 14B. The counter 25 includes a clock (CLK) input terminal for counting up the counter and a reset (R) terminal for resetting the counter back to the decimal zero state. The four output terminals for the counter 25 are identified in the drawing as the Q1, Q2, Q3 and Q4 terminals, reading from the top to the bottom of the counter representative of the binary coded decimal count as described hereinabove. The counter 25 functions with the multiplexing switching circuit 26, U4A, which may be the Fairchild Semiconductor Corporation's analog multiplexer/demultiplexer model CD 4051 BC which is a single 8 channel multiplexer having three binary control inputs A, B, and C respectively connected to the counter 25 output circuits Q1, Q2, and Q3 for receiving the binary coded output signals counted up to seven. The three binary signals select 1 of 8 channels to be turned "ON" and connect input to the output. As illustrated in FIG. 14B, the three terminals ground 8 (gnd), inhibit 6 (in H) and D7 terminals are connected in common to ground level. The Vcc terminal is connected to a plus 5 volt source and the input terminal 3 is connected to the variable arm for the resistor Rfreq. The R0 resistor is 1000 ohms while each of the resistors R1-R7 of the ladder network 27 are each on the order of 51 to 68 ohms. As the counter 25 counts up one decimal count, the switching circuit 26 selects the channel corresponding to the decimal count of the counter to select the individual resistor of the network to be added in series into the frequency changing circuitry 22, i.e. The decimal count 5 selects resistor R5 to be added to the circuit, as noted hereinabove.

The output terminal 8 of U1A, 21 is connected to a +5 volt source through the series resistor 22 and the capacitor C14 to ground level. The terminal member 7 of U1A is connected directly to ground. The output signal of detector 21 is coupled through a series of inverters U2A, U2B and U2C for shaping the detector 21 output signal for count processing. These inverters may be Texas Instruments Corporation CMOS Schmitt Triggers, integrated circuit packages of CD40106B types that function as inverters. Inverter U2C provides a drive signal for light emitting diode PLL LED1 which LED1 illuminates in response to a drive signal indicating the detector 21 has locked on to the input frequency signal. The circuit path for LED1 is completed through resistor R11 to ground; see FIG. 14C. The output signal from inverter U2B is coupled as an input signal to timing circuit 24 and the counter 25. The timing circuit 24, U5, may be a monostable multivibrator of the type of National Semiconductor Corporation integrated circuit package CD4528BM. The timing window is triggered at terminal B by the signal from inverter U2B and the output pulse width is dependent on the values of RTiming connected to terminal 2 of U5 and capacitor CT connected to terminal 1 of U5. The time window provided by timing circuit 24, U5, is set to allow the detector 21 sufficient time interval to recognize and detect the siren sound. During this time interval the counter 25 is enabled by the Q output of U5 applied to counter 25 through resistor R9 to the reset terminal. Input terminal A for U5 is connected directly to ground. Terminal C/D is the reset terminal for one-shot element U5 while output terminal 6, Q, is coupled to an inverter U2 having its output connected to resistor 12 and in turn to sensing LED1A and to ground as illustrated in FIG. 14C. When the timing circuit 24 is triggered, its output circuit goes to a high state causing the sensing LED1A to illuminate thereby signaling that the time window has commenced and the counter 25 can count. When the detector 21 falls out of lock due to the decrease in siren frequency, the output pin Q of timer 24 goes low disabling the reset (R) input terminal of counter 25 and enabling the counter through the clock input terminal 4 in response to the lock and unlock cycles. The output signal from inverter U2 is coupled to the clock input terminal C of counter 25 in response to the unlocking of the detector 21. This enables the switching circuit 26 to count up the lock-unlock cycles of detector 21 and each count selects an additional resistor of the ladder network 27 to be added to the timing resistor for the detector 21. With all of the lock-unlock cycles of the detector 21 occurring during the time window, the counter 25 counts through 7 counts. On the eighth count of counter 25, the output terminal Q4 will be in a high state and the other terminals Q1-Q3 are all low, or 0001. The signal at the Q4 output of counter 25 is directly connected to the S1 input terminal of element U6, see FIG. 14C, functioning as a flip-flop or a bistable output signal. A commercially available integrated circuit package that fulfills the function of element U6 is the Fairchild Semiconductor Corporation package CD 4043BC comprising NOR latches for providing the bistable signaling required. The output signal from U6 may drive a transistor for energizing a relay that causes it to close a pair of contacts (not shown) and apply a signal to the traffic light controller 31 to override its normal light control function and provides a "green" signal to the traffic light for permitting the detected siren of the emergency vehicle to proceed through the intersection with the right of way.

The above described circuit operation is based on a pair of acoustic horn-microphone sensors functioning to detect siren sounds emitted from an emergency vehicle traveling north or south to reach the intersection. The north traveling vehicle is assumed so that the dominant signal is provided by amplifier 1A. If a south traveling vehicle is sensed, the dominant signal will be derived from amplifier 1B and the circuit operation will be the same. The number of acoustic horn-microphone sensors can be varied in accordance with the configuration of the intersection. A siren sensor assembly SSA having four combinations of acoustic horns and microphone for detecting the siren sounds at a typical intersection, as illustrated in FIG. 1, is disclosed in provisional application No. 60/732,938 and the entire disclosure in the application is incorporated herein by reference.

Figure 15A:
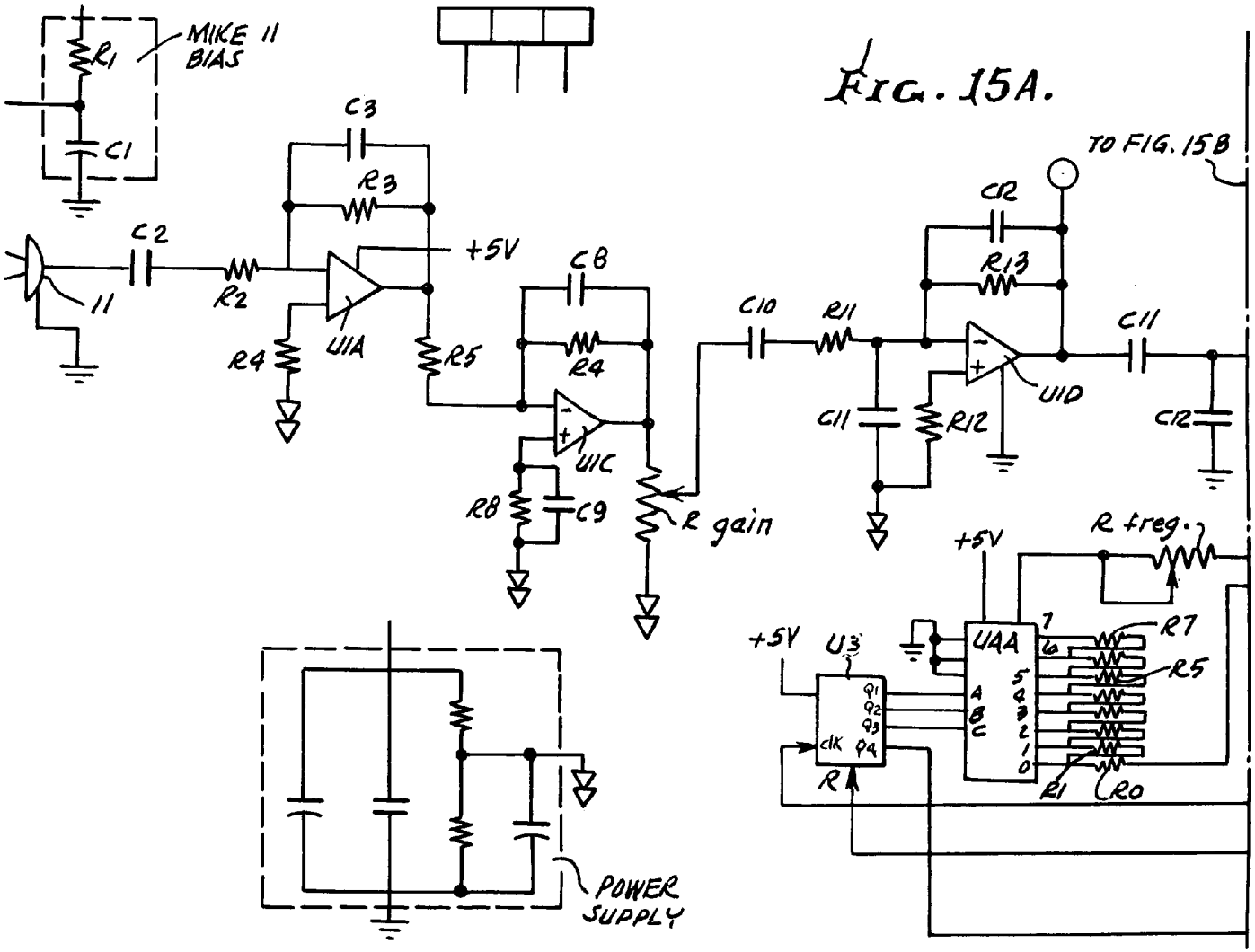
FIGS. 15A and 15B, taken together, are a schematic circuit diagram of another embodiment of the electronic processing circuitry for 1 of 4 channel selectors for a single acoustic horn-microphone combination embodying the invention.
Figure 15B:
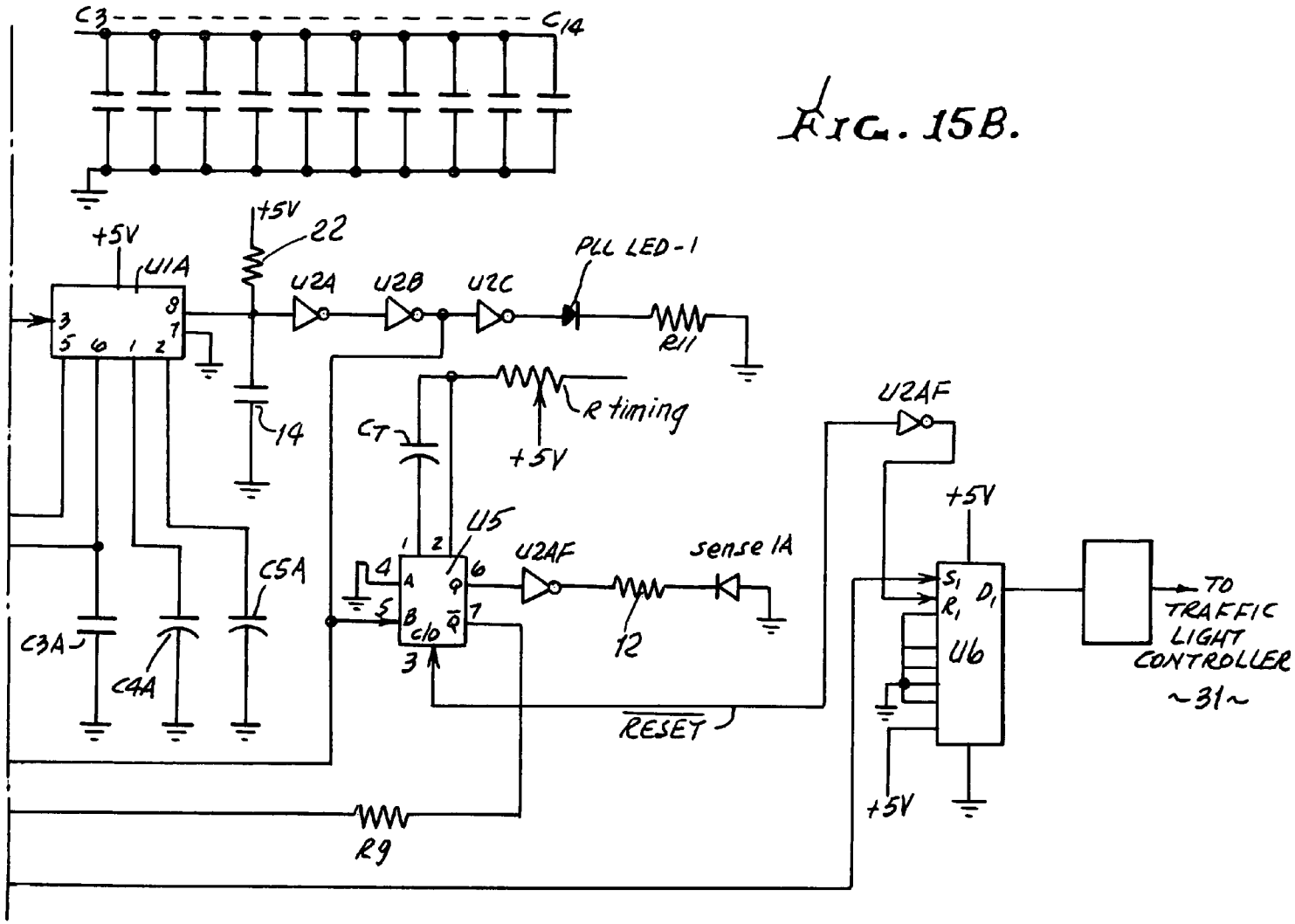

Now referring to FIGS. 15A and 15B wherein a siren sensor assembly SSA for a single acoustic horn-microphone combination is illustrated for detecting a siren sound rather than an assembly of 2 or 4 assemblies. The operation of the circuits of FIGS. 15A and 15B for processing the output of an acoustic horn-microphone combination will be explained. The pre-amplifiers comprise three operational amplifiers identified as U1A, U1C, and U1D. Each of the amplifiers are the same operational amplifiers as in previous embodiments, namely the Texas Instrument package LM 324A. The microphone 11 output signal is coupled to amplifier U1A. The amplifier U1A has an appropriate gain and frequency response to assure the maximum sensitivity to the frequency spectrum of the siren sounds. This is provided by the suitable sized input components, capacitor C2 and C3 and resistors R2, R3 and R4. The bias for the electrets condenser type microphone 11 is provided by the bias source 11 illustrated in dotted outline and comprising the resistor R1 and capacitor C1. The output signal from pre-amplifier U1A is further amplified by amplifier U1C. The capacitors C3 and C8 in the feedback loops for amplifiers U1A and U1C, respectively add further rejection of high frequency signals and noise. The output signal of amplifier U1C is further amplified and frequency band limited by amplifier U1D and the associated U1D input components namely capacitors C10, C11, and C12 and resistors R11, R12 and R13. A unique filtering structure is defined by the latter C and R components to further discriminate and band pass only sounds in the siren frequency spectrum. This is accomplished by causing amplifier U1D biased in a near oscillation mode, the oscillatory frequency is determined by the components Rgain, C10, and C11 and resistors R11, R12 and R13. These components provide a nominal frequency of approximately 1800 Hertz, just above the high end of the siren frequency spectrum. Capacitor C12 is an important element of the desired function for amplifier U1D in that it stabilizes the amplifier from going into oscillation. Also note FIG. 12. The signals received from amplifier U1C that are in the siren frequency spectrum below the 1800 Hertz are "locked on" by amplifier U1D since this amplifier basically goes into oscillation and phase locks to the input signal thus providing the filtering action that has an extremely high Q over the entire frequency range of the siren bandwidth.

The above described circuit operation as to filtering action and suppression of oscillation is also true of the operation of amplifier U2D and capacitor C8 as illustrated in FIG. 14A. The filtering action is also disclosed in the aforementioned provisional application page 2, first paragraph and is illustrated on sheet 2 of the disclosure.

The above described amplification and signal processing is completely identical for each siren signal detectors 21. The predominant siren signal developed will cause its associated signal detector to count through a pre-selected number, such as eight, of the lock-unlock cycles triggering the detection of a valid siren signal and the resulting signal applied to the conventional traffic light control for causing the correct green signal to be provided to the emergency vehicle at the intersection.

A typical intersection as described hereinabove is illustrated in FIG. 17 wherein a single horn-microphone assembly is utilized for detecting the movement of an emergency vehicle in one of the four directions, north, south, east and west. All of the signal processing circuits for an individual direction of movement are interlocked with one another by means of the Interface lock out logic, shown in block form as element 41 in FIG. 17. The individual detector signal processing circuitry that counts through the pre-selected number of counts of lock-unlock cycles first will lock out the other three signal processing detectors via their master resets. The output signals for all four directions of movement toward the intersection are coupled to the traffic light control system 31 to cause a reset signal to be coupled back to each signal processing circuit, as illustrated. The dominant signal producing detector will stay in its triggered state until a reset signal is provided to all of the signal detect-processing signals through the interface logic lock out circuitry 41.

When the electronic signal processing circuit is used to give a warning signal to a motor vehicle operator of an approaching emergency vehicle having a sounding siren in response to siren sensor output as illustrated in FIG. 18 is an alternate use of such an output signal. The motor vehicle operator can be warned of the approaching emergency vehicle by coupling the siren sensor output signal of FIG. 18 to control the actuation of the alarm signals as described in our earlier U.S. Pat. No. 5,278,553 in conjunction with FIG. 4 thereof and description in col. 9, 1. 45 et seq. The siren signal output signal of FIG. 18 can be used to control the actuation of the alarm signals by controlling the normally de-energized alarm switch 20 as described in col. 9, 1. 46 et seq. of U.S. Pat. No. 5,278,553 and which description and operation is integrated herein in its entirety by reference.

Figure 6:
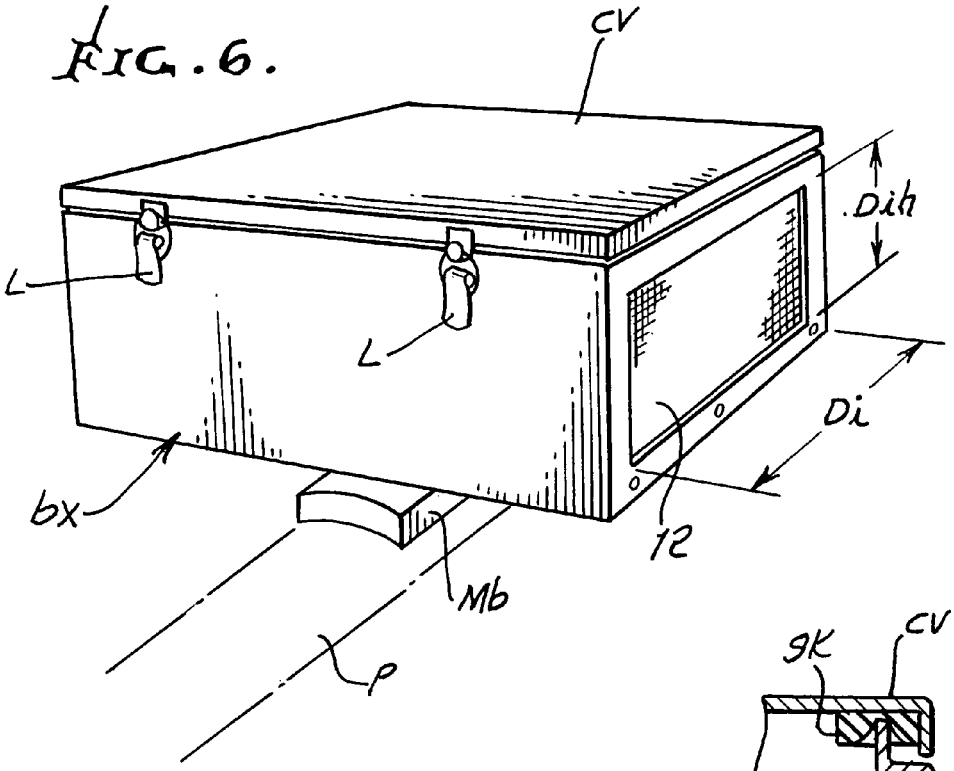
FIG. 6 is a perspective view of a siren sensor housing mounted to a traffic light supporting rod as shown in FIG. 2.

With all of the above structure in mind, the siren sensor assembly SSA for mounting on a light pole P and/or light pole TP as illustrated in FIG. 2 will now be examined in conjunction with FIGS. 6-11 in conjunction with the two horn assembly SSA. The siren sensor assembly SSA for housing a pair of acoustic horn-microphone combinations along with the individual electronic signal processing circuitry mounted on a printed circuit board PCB and the associated electronic components are housed in a rectangular box bx are best appreciated by viewing the open box in FIGS. 7 and 8. The box bx has a hinged cover CV. The inside of the cover CV is illustrated with a gasket gk around its four edges of a pre-selected width for sealingly securing the cover CV to the box proper as shown in FIG. 6. The cover CV is also provided with a pair of spaced mechanical latches L for securing the cover CV to the box bx as shown in the latched condition in FIG. 6. To prevent tampering the cover CV may also be provided with a lock so that only authorized personnel may open up the box bx to inspect the assembly SSA for maintenance, repairs, etc. As previously described the acoustic horns and microphone assemblies are mounted, end to end inside the box bx adjacent open sides of the box bx with the environmentally protected end of the horns secured to the box bx by the fasteners F, see FIG. 9. The bottom of the box bx is provided with a mounting bracket Mb extending the length of the box intermediate the ends and having a complimentary arcuate configuration for mounting to a pole P; see FIGS. 6, 10 and 11. The mounting bracket Mb is a constructed to be integral with the box bx and is secured inside the box by a pair of bracket heads Mbh; see FIGS. 10 and 11. The mounting bracket Mb may be tightly secured to the mounting pole P by means of fasteners Mbf extending through the pole P as shown in FIG. 11. The box bx can be modified to house additional acoustic horns or a single horn as should be appreciated by those skilled in the art.

The alternate configuration of the siren sensor assembly SSA mounted vertically on the pole P, rather than horizontally on the pole P, as illustrated in dotted outline in FIG. 2 may also be readily adapted to be mounted and secured to the pole P.

Figure 16A:
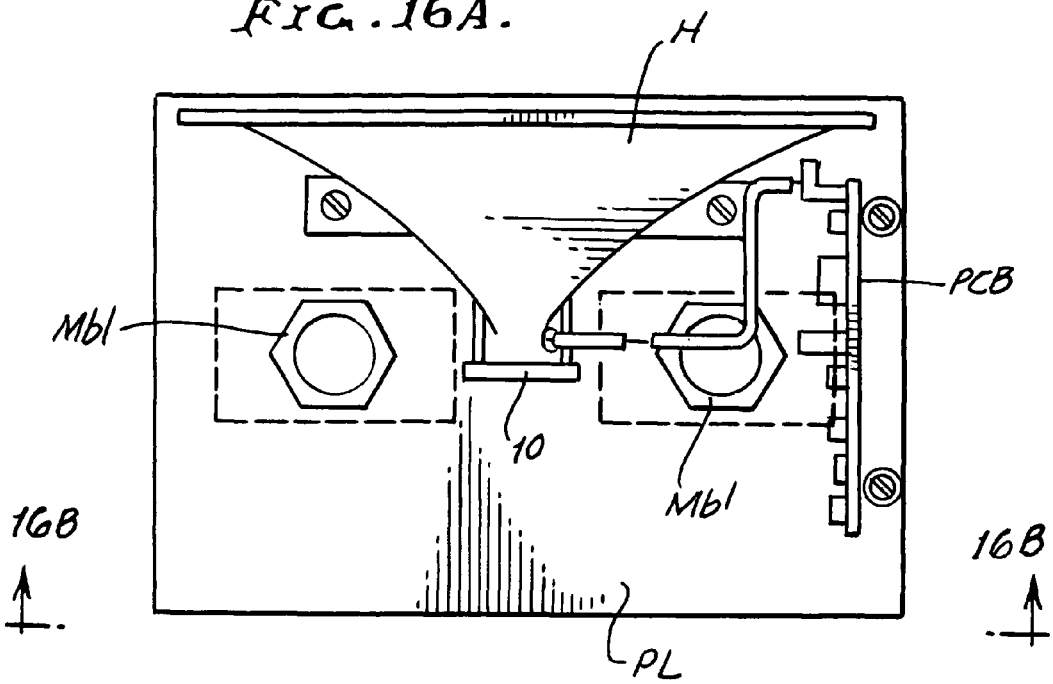
FIG. 16A is a top plan view of the siren sensor packaging for a single acoustic horn-microphone arrangement for mounting to a traffic line pole.
Figure 16B:
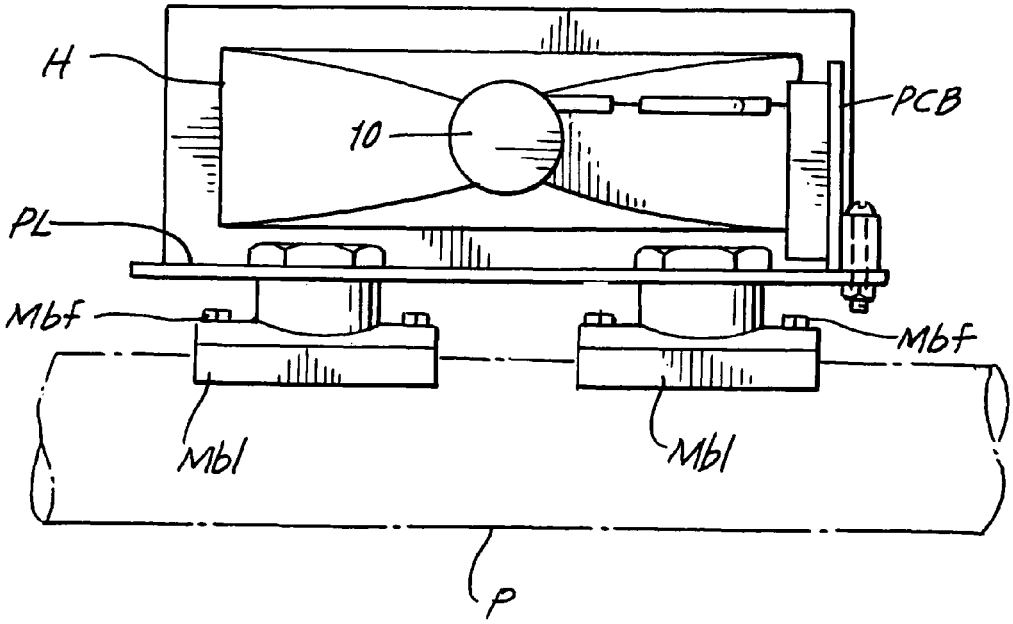
FIG. 16B is a view taken along the line 16B-16B of FIG. 16A illustrating the siren sensor packaging mounted on a light pole with the pole illustrated in dotted outline.

When a single acoustic horn H-microphone 11 assembly is utilized it may be mounted to an open, single supporting plate PL provided with a pair of spaced mounting brackets Mbl for securement to a light pole P as illustrated in FIGS. 16A and 16B. When this type of packaging is resorted to the acoustic horn H and associated components may have a protective coating applied thereto to lengthen the life from the environmental factors tending to cause degradation of the horn, etc.

It should now be appreciated by those skilled in the art that the siren sensor assembly of the present invention has advanced the state of the art by the provision of a relatively inexpensive and very reliable method and apparatus for detecting and identifying a siren sound so as to provide a highly accurate and reliable signal for controlling the traffic control light signal for permitting an emergency vehicle to travel through an intersection without fear of a collision or other impediments from causing the emergency vehicle to slow down so as to be used commercially in heavy traffic areas. The validity of the sensed siren signal also permits its use for warning a motor vehicle operator that a siren sounding emergency vehicle is approaching in sufficient time to allow the operator to take the necessary action to avoid the approaching emergency vehicle.

The invention claimed is:

1. An apparatus for electronically detecting valid siren sound emitted from an emergency motor vehicle having a sounding siren, said siren being characterized as emitting loud, audible frequencies that cyclically vary with time between a high "B" frequency to a low "A" frequency for sounding a warning siren sound, said siren being characterized as being rich in harmonic overtones, comprising:

means for receiving said siren sound frequencies and converting the received sounds to corresponding electrical signals, first operational amplifier circuit means coupled to said receiving means and amplifying the electrical signals coupled thereto and filtering out any high frequency signals, second operational amplifier circuit means having input and output terminals, circuit means coupled to the input terminals of said second amplifier circuit means for biasing said amplifier means in a near oscillatory mode at a pre-selected frequency above the frequency of the high frequency end or "B" frequency of the siren frequency range, feedback circuit means comprising a parallel circuit means network of a resistor and capacitor connected between the input and output terminals of second amplifying means, said feedback capacitor being selected and proportioned for stabilizing said second amplifier means for preventing said amplifier means from going into oscillation at said frequency above the siren frequency range and thereby causing said input circuit means for second amplifying means to function as a band pass filter that is frequency band limited to said siren sound frequencies applied to said second amplifying means, a frequency adjustable, phase lock detector circuit means arranged for detecting pre-selected frequencies including a pre-selected frequency range below said high "B" frequency and a frequency range above said low "A" frequency for locking said detector circuit means to said pre-selected frequency below said "B" frequency and providing an electrical output signal representative of said locked condition upon receipt of said signal below said high "B" frequency, said phase lock detector circuit means being coupled to a frequency setting network for setting said detector circuit means to said pre-selected high frequency, said frequency setting network comprising a combination of resistor and capacitor means for defining said pre-selected high frequency for said detector circuit means, said detector circuit means causing the lock up of said detector circuit means upon receipt of a signal having said pre-selected high frequency and causing the unlocking thereof upon the signal undergoing processing decreasing in frequency, resistor ladder network means including an individual resistor means continuously connected in combination with said frequency setting network for defining said pre-selected frequency for locking said phase lock detector, as the siren signals decrease from said pre-selected high "B" frequency to said pre-selected low "A" frequency, timing circuit means for timing a pre-selected time interval between the locking and unlocking periods of said phase lock detector circuit means and coupled to the output signal for said phase lock detector for initiating the timing period upon detection of a locking frequency, a binary coded decimal counter having input terminals and binary coded decimal output terminals, an input terminal for said counter being coupled to be responsive to said output signal for said phase lock detector upon receipt of a locking signal frequency for enabling said counter to count up, said output terminals for said counter providing binary coded decimal signals representative of the counters' count, said counter having a pre-selected total decimal count, multiplexing circuit means coupled to pre-selected output terminals of said counter and to said ladder network and providing an individual output count signal corresponding to the decimal count of said counter in response to the receipt of said inputted binary coded decimal signals, and effective to serially select and add a corresponding resistor or resistors from said ladder network for defining a lower high "B" frequency as the input signals coupled to said detector circuit means decrease in frequency, the "zero" output count of the counter causing a pre-selected resistor of said ladder network to be continuously connected in combination with the frequency setting network for determining the pre-selected high frequency below said "B" frequency lockout frequency of said phase lock detector circuit means, the decreasing frequencies of the input siren signals causing said phase lock detector circuit means therefrom upon the unlocking thereof that is coupled to said counter input terminal and causes said counter to count up one decimal count for each lock-unlock sequence that occurs during the pre-selected time interval of said timing circuit and thereby causing an additional resistor or resistors to be added to said pre-selected resistor of said ladder network to said frequency setting network for defining a lower frequency for said detector circuit means, upon said counter counting up to said pre-selected count, the counter directly provides an output signal representative of the complete tracking of the siren signal from said pre-selected high "B" siren frequency to the low "A" frequency incrementally in accordance with the total decimal count selected for said counter, and means coupled to said output signal representative of the complete tracking of the siren signal from said "B" frequency to said "A" frequency for signaling the detection of a valid siren sound signal.

2. An apparatus for electronically detecting a valid siren sound as defined in claim 1, wherein said pre-selected high frequency is a pre-selected harmonic of said high frequency along with remaining pre-selected frequencies for locking up said detector circuit means.

3. An apparatus for electronically detecting a siren sound as defined in claim 2, wherein said harmonic is the third harmonic of said high frequency.

4. An apparatus as defined in claim 1 or 2, including means coupled to receive said signal representative of a valid siren sound signal for utilizing same for controlling electrical traffic signals.

5. An apparatus as defined in claim 1 or 2, including means mounted in a motor vehicle to receive said signal representative of a valid siren sound signal for utilizing same for signaling a motor vehicle operator that an emergency vehicle having a sounding siren is approaching.

6. An apparatus for electronically detecting a valid siren sound as defined in claim 1 wherein said means for receiving said siren sound frequencies comprises:

a sound receiving horn having pre-selected dimensions for receiving said siren sound frequencies, said horn having a cone-like shape having a large sound receiving opening at one end and tapering to a relatively small, closed end wherein said horn functions as an acoustic lens having a focal point adjacent said closed end for said horn, and sound receiving means coupled to said horn adjacent said focal point for detecting the siren sound frequencies thereat and converting the received sounds to corresponding electrical signals.

7. An apparatus for electronically detecting a valid siren sound as defined in claim 1 or 6 wherein said first operational amplifier circuit means includes means to assure maximum sensitivity to the electrical signals representative of the siren sound frequencies.

8. A method of controlling the traffic control signals at an intersection of two roads to permit only an emergency vehicle to proceed through the intersection having the right of way due to the provision of a "green" traffic signal for the emergency vehicle, mounting a siren sound sensor adjacent an intersection of at least two intersecting roads and providing electrical signals representative of the sound picked up by the microphone, said microphone being sensitive to emergency vehicle's siren sounds emitted from an emergency vehicle, said microphone being oriented and axially arranged to receive the emergency vehicle siren sounds from an emergency vehicle approaching an intersection, mounting a plurality of similar siren sound sensors adjacent the intersection of said two roads similar to the first mentioned siren sound sensor whereby the intersection is monitored by four siren sound sensors spaced approximately 90 degrees apart for receiving siren sounds from an emergency vehicle approaching the intersection from different directions, each of said siren sound sensors comprising a microphone and acoustic horn arranged in a complimentary acoustic electronic arrangement that provides a tuned and directional audio sensor sensitive to the frequent range of the sound from an emergency vehicle's siren, each of said acoustic horns and microphone having individual pre-amplifying circuit means and siren sensing electronic means and having the microphone facing in the direction of travel of an emergency vehicle approaching the intersection so that each acoustic horn-microphone siren sound sensor is facing 90 degrees from each other acoustic horn-microphone siren sound sensors at a typical four way intersection for monitoring emergency vehicles traveling north, south, east and west toward said intersection, said pre-amplifying circuit means for each individual acoustic horn-microphone combination receiving the siren sound signals from an individual microphone for the individual acoustic horn-microphone combination, said arrangement of pre-amplifying means and acoustic horn-microphone combinations will provide a dominant level of electrical output signals in response to the detected siren sounds emitted that are "on axis" with the emergency vehicle's siren which is heading towards the intersection, said siren sensing electronic means for each individual amplifying means comprising phase lock loop detection means including filtering circuit means for the electronic signals received from an individual pre-amplifying means having a band pass for transmitting only the frequency signals comprising the siren signals frequency range to said electronic means, said phase lock loop detection means being adapted to lock to said filtered siren signals to lock onto a high "B" frequency to a low "A" frequency and unlock said detection means as said siren signals decrease in frequency, continuously adjusting the high "B" frequency of said detection means as said siren signals decrease in frequency between said high "B" frequency and low "A" frequency for detecting and tracking the locking and unlocking cycles of said detection means over the range of siren sound signals applied thereto, and counting a pre-selected number of locking and unlocking cycles in response to the decreasing frequencies of said siren sound signals so that detection means that counts up to said pre-selected number first will finalize and lock out the other detection means and provide an output signal representative of a valid siren sound signal being detected.

* * * * *

UNITED STATES PATENT AND TRADEMARK OFFICE

CERTIFICATE OF CORRECTION

PATENT NO. : 8,094,040 B1
APPLICATION NO. : 11/591155
DATED : January 10, 2012
INVENTOR(S) : Robertt H. Cornett It is certified that error appears in the above-identified patent and that said Letters Patent is hereby corrected as shown below:

Column 12, line 48 Q should be $\bar{Q}$

Signed and Sealed this
Tenth Day of April, 2012

David J. Kappos

David J. Kappos
*Director of the United States Patent and Trademark Office*